US009524682B2

(12) United States Patent
El-Ghoroury et al.

(10) Patent No.: US 9,524,682 B2
(45) Date of Patent: Dec. 20, 2016

(54) DYNAMIC GAMUT DISPLAY SYSTEMS, METHODS, AND APPLICATIONS THEREOF

(71) Applicant: Ostendo Technologies, Inc., Carlsbad, CA (US)

(72) Inventors: Hussein S. El-Ghoroury, Carlsbad, CA (US); Andrew J. Lanzone, San Marcos, CA (US)

(73) Assignee: Ostendo Technologies, Inc., Carlsbad, CA (US)

( * ) Notice: Subject to any disclaimer, the term of this patent is extended or adjusted under 35 U.S.C. 154(b) by 0 days.

(21) Appl. No.: 14/452,392

(22) Filed: Aug. 5, 2014

(65) Prior Publication Data

US 2014/0340434 A1 Nov. 20, 2014

Related U.S. Application Data

(63) Continuation of application No. PCT/US2014/029637, filed on Mar. 14, 2014.

(Continued)

(51) Int. Cl.

*G09G 5/10* (2006.01)
*G09G 3/34* (2006.01)

(Continued)

(52) U.S. Cl.

CPC ..... *G09G 3/3413* (2013.01); *G09G 3/2096* (2013.01); *G09G 3/3607* (2013.01);

(Continued)

(58) Field of Classification Search

CPC .. G09G 2310/027; G09G 3/3413; G09G 5/02; G09G 3/2096; G09G 3/3607; G09G 5/04; G09G 2340/06; G09G 2350/00; G09G 2320/0242; G09G 2320/0271; G09G 2320/0646; G09G 2320/0666

(Continued)

(56) References Cited

U.S. PATENT DOCUMENTS 4,596,992 A 6/1986 Hornbeck
5,226,063 A 7/1993 Higashitsutsumi (Continued)

FOREIGN PATENT DOCUMENTS

CN 1595491 3/2005
CN 1605041 4/2005

(Continued)

OTHER PUBLICATIONS

"International Search Report and Written Opinion of the International Searching Authority Dated Aug. 20, 2014; International Application No. PCT/US2014/029637", (Aug. 20, 2014).

(Continued)

*Primary Examiner* — Jonathan Boyd

(74) *Attorney, Agent, or Firm* — Blakely Sokoloff Taylor & Zafman LLP

(57) ABSTRACT

In the dynamic gamut display systems, video input data is processed to extract metrics indicative of the gamut occupancy of the frame pixels. The extracted metrics are used to form a set of scale factors to be used by the display to synthesize an adapted gamut that matches the frame pixel color gamut from the native color primaries of the display. The generated gamut adaptation scale factors are used to convert the frame pixels' values to the adapted gamut which are provided to the display for modulation using the synthesized adapted gamut for each video frame or a sub-region of a video frame. The methods enable increased display brightness, reduced power consumption and reduced interface and processing bandwidth. Also disclosed is an adapted video frame data formatting method that maps the benefits of the adapted gamut into a reduced frame data size enabling bandwidth savings when used for video distribution.

31 Claims, 9 Drawing Sheets

Related U.S. Application Data

(60) Provisional application No. 61/800,504, filed on Mar. 15, 2013.

(51) Int. Cl.

| | |
|---|---|
| ***G09G 5/02*** | (2006.01) |
| ***G09G 3/20*** | (2006.01) |
| ***G09G 3/36*** | (2006.01) |
| *G09G 5/04* | (2006.01) |

(52) U.S. Cl.
CPC ..... *G09G 5/02* (2013.01); *G09G 5/04* (2013.01); *G09G 2320/0242* (2013.01); *G09G 2320/0271* (2013.01); *G09G 2320/0646* (2013.01); *G09G 2320/0666* (2013.01); *G09G 2340/06* (2013.01); *G09G 2350/00* (2013.01)

(58) Field of Classification Search
USPC ..... 345/690
See application file for complete search history.

(56) References Cited

U.S. PATENT DOCUMENTS

| | | | | |
|---|---|---|---|---|
| 5,280,277 | A | 1/1994 | Hornbeck | |
| 5,526,063 | A | 6/1996 | Joubert et al. | |
| 5,535,047 | A | 7/1996 | Hornbeck | |
| 6,342,897 | B1 | 1/2002 | Wen | |
| 6,360,007 | B1 | 3/2002 | Robinson et al. | |
| 6,707,516 | B1 | 3/2004 | Johnson et al. | |
| 6,769,772 | B2 | 8/2004 | Roddy et al. | |
| 6,910,777 | B2 | 6/2005 | Ito | |
| 6,947,589 | B2 | 9/2005 | Newman et al. | |
| 7,101,049 | B2 | 9/2006 | Shindoh | |
| 7,113,307 | B1 | 9/2006 | Ohkubo | |
| 7,210,806 | B2 | 5/2007 | Holman et al. | |
| 7,333,080 | B2 | 2/2008 | Miller et al. | |
| 7,334,901 | B2 | 2/2008 | El-Ghoroury | |
| 7,623,560 | B2 | 11/2009 | El-Ghoroury et al. | |
| 7,767,479 | B2 | 8/2010 | El-Ghoroury et al. | |
| 7,829,902 | B2 | 11/2010 | El-Ghoroury et al. | |
| 8,049,231 | B2 | 11/2011 | El-Ghoroury et al. | |
| 8,098,265 | B2 | 1/2012 | El-Ghoroury et al. | |
| 8,243,770 | B2 | 8/2012 | El-Ghoroury et al. | |
| 8,567,960 | B2 | 10/2013 | El-Ghoroury et al. | |
| 2003/0053683 | A1 | 3/2003 | Newman et al. | |
| 2004/0036668 | A1 | 2/2004 | Nakanishi | |
| 2005/0024384 | A1* | 2/2005 | Evans et al. | 345/604 |
| 2005/0212728 | A1 | 9/2005 | Miller et al. | |
| 2005/0280850 | A1 | 12/2005 | Kim et al. | |
| 2006/0104058 | A1* | 5/2006 | Chemel et al. | 362/231 |
| 2006/0238723 | A1 | 10/2006 | El-Ghoroury | |
| 2007/0058087 | A1 | 3/2007 | Kettle et al. | |
| 2007/0064007 | A1 | 3/2007 | Childers et al. | |
| 2007/0064008 | A1 | 3/2007 | Childers | |
| 2007/0279372 | A1 | 12/2007 | Brown Elliott et al. | |
| 2008/0150958 | A1* | 6/2008 | Higgins | 345/591 |
| 2008/0204382 | A1 | 8/2008 | Lim et al. | |
| 2009/0086170 | A1 | 4/2009 | El-Ghoroury et al. | |
| 2009/0174638 | A1 | 7/2009 | Brown Elliott et al. | |
| 2009/0278867 | A1* | 11/2009 | Brown Elliott et al. | 345/690 |
| 2009/0278998 | A1 | 11/2009 | El-Ghoroury et al. | |
| 2010/0003777 | A1 | 1/2010 | El-Ghoroury et al. | |
| 2010/0013748 | A1 | 1/2010 | Cok et al. | |
| 2010/0066921 | A1 | 3/2010 | El-Ghoroury et al. | |
| 2010/0091050 | A1* | 4/2010 | El-Ghoroury et al. | 345/691 |
| 2010/0165139 | A1* | 7/2010 | Muijs et al. | 348/222.1 |
| 2010/0220042 | A1 | 9/2010 | El-Ghoroury et al. | |
| 2011/0025592 | A1* | 2/2011 | Botzas et al. | 345/102 |
| 2012/0033113 | A1 | 2/2012 | El-Ghoroury et al. | |
| 2012/0194578 | A1* | 8/2012 | Znamenskiy et al. | 345/694 |
| 2012/0287146 | A1 | 11/2012 | Brown Elliott et al. | |

FOREIGN PATENT DOCUMENTS

| | | |
|---|---|---|
| CN | 101180888 | 5/2008 |
| CN | 101257752 | 9/2008 |
| EP | 1315384 | 5/2003 |
| JP | 2004-140800 | 5/2004 |
| JP | 2008-203308 | 9/2008 |
| JP | 2008-538681 | 10/2008 |
| TW | 295631 | 1/1997 |
| TW | 200729149 | 8/2007 |
| WO | WO-2006/089041 | 8/2006 |
| WO | WO-2006/115852 | 11/2006 |
| WO | WO-2007/143340 | 12/2007 |

OTHER PUBLICATIONS

Jansen, Michael , et al., "Visible Laser and Laser Array Sources for Projection Displays", *Proc. of SPIE* vol. 6135, (2006), pp. 61350T-1 to 61350T-6.

Kim, Moon-Cheol , "Comparative color gamut analysis of xvYCC standard", *Displays*, vol. 29, (2008), pp. 376-385.

Kim, Moon-Cheol , "Optically adjustable displays color gamut in time-sequential displays using LED/Laser light sources", *Displays*, vol. 27, No. 4-5, (Nov. 1, 2006), pp. 137-144.

Poynton, Charles , "Digital Video and HDTV Algorithms and Interfaces", Elsevier Science, ISBN 1-55860-792-7, (2003), pp. 233-253.

* cited by examiner

DYNAMIC GAMUT DISPLAY SYSTEMS, METHODS, AND APPLICATIONS THEREOF

CROSS-REFERENCE TO RELATED APPLICATIONS

This application is a continuation of International Application No. PCT/US2014/029637 filed Mar. 14, 2014 which claims the benefit of U.S. Provisional Patent Application No. 61/800,504 filed Mar. 15, 2013.

BACKGROUND OF THE INVENTION

1. Field of the Invention

This invention relates generally to the display of image and video data using solid state light (SSL) based displays, more particularly to methods for adaptation of the display gamut to match the actual video frame or frame sub-region color distribution gamut.

2. Prior Art

REFERENCES CITED

[1] U.S. Pat. No. US 7,334,901, Low Profile, Large Screen Display System Using Rear Projection Array System, El-Ghoroury, Feb. 26, 2008

[2] U.S. Pat. No. 8,098,265, Hierarchical Multicolor Primaries Temporal Multiplexing System, El-Ghoroury et al, Jan. 17, 2012

[3] U.S. Pat. No. 7,623,560, Quantum Photonic Imagers and Methods of Fabrication Thereof, El-Ghoroury et al, Nov. 24, 2009

[4] U.S. Pat. No. 7,767,479, Quantum Photonic Imagers and Methods of Fabrication Thereof, El-Ghoroury et al, Aug. 3, 2010

[5] U.S. Pat. No. 7,829,902, Quantum Photonic Imagers and Methods of Fabrication Thereof, El-Ghoroury et al, Nov. 9, 2010

[6] U.S. Patent Application No. US 2005/0280850, Color Signal Processing Apparatus and Method, Kim et al, Nov. 9, 2010

[7] U.S. Pat. No. 6,947,589, Dynamic Gamut Mapping Selection, Newmann et al, Sep. 20, 2005

[8] U.S. Pat. No. 6,360,007, Dynamic Optimized Color LUT Transformation Based Upon Image Requirements, Robinson et al, Mar 19, 2002

[9] PCT Patent Application No. WO 2007/143340, High Dynamic Contrast System Having Multiple Segmented Backlight, Elliott et al, Dec. 13, 2007

[10] U.S. Pat. No. 7,113,307, Color Correction Definition Method, Ohkubo, Sep. 26 19, 2006

[11] U.S. Pat. No. 7,333,080, Color OLED Display with Improved Power Efficiency, Miller et al, Feb 19, 2008

[12] Moon-Cheol Kim, Optically Adjustable Display Color Gamut in Tim-Sequential Displays using LED/Laser Light Sources, Displays 27 (2006) 137-144

[13] Charles Poynton, Digital Video and HDTV Algorithms and Interfaces, pp. 233-253, Elsevier Science, ISBN: 1-55860-792-7, 2003

Central to most color display systems, such as liquid crystal display (LCD), spatially modulated projection displays using micro-mirror devices or liquid crystal on silicon (LCoS) devices, and organic light emitting diode (OLED) displays, is the capability to modulate the video frame pixels using a given native color gamut. In displays such as LCD and OLED, for example, the color gamut is determined by a set of color filters placed on top of each of the display's pixels. The native gamut of these types of displays is fixed and set at a given display gamut standard, for example HDTV or NTSC, and cannot be changed. The advent of solid state light (SSL) has made it possible to create SSL-based displays which typically have much wider gamut than most of the currently used video display color gamut Ref [1-5]. Furthermore, the fast switching capabilities and possible simultaneity of SSL sources make it possible to change the SSL-based display gamut in real-time by simultaneously turning on and changing the duty cycle of the multiple color primaries SSL sources of the display. Therefore, unlike conventional displays with fixed color gamut capability, SSL-based displays offer the capability to change (or adapt) the active display gamut in real-time to better suit the intended application.

Prior art Ref [1] describes a SSL-based a rear projection array display system and methods that make use the real-time controllability of its SSL color primaries to maintain the color and brightness uniformity across its displayed image which is formed by an array of multiple SSL-based micro-projectors. In Ref [1], the native gamut of the multiple SSL-based micro-projectors comprising the rear projection array system are converted into a common reference gamut, then the brightness and color point output of each micro-projector is detected using built-in sensors, compared to the output of other micro-projectors in the rear projection array, then the color primaries (or gamut) of each of the SSL-based micro-projectors forming the display image is corrected in real-time to maintain uniform color (chromaticity) and brightness (luminance) across displayed multi segment image.

Prior art Ref [2] describes a SSL-based a projection display system in which a hierarchical method is used to convert the native gamut provided by its SSL sources to a desired reference gamut while maintaining independent control of the display system brightness and white point chromaticity. The methods described in Ref [2] make use the simultaneity and real-time controllability of the display system SSL color primaries to temporally multiplex the display SSL color primaries in order to synthesize any desired gamut having any desired brightness and/or white point chromaticity. The methods described in Ref [2] provide independent control of the synthesized gamut color primaries chromaticity, brightness and white point using a multi level hierarchical control structure that provides control level independency and invariance as well as processing invariance in order to realize a computationally efficient and cost effective control system of SSL-based displays.

Prior art Ref [3-5] describe an emissive spatial light modulation device and related display systems comprising an array of multiple independently addressable micro-scale SSL pixels whereby each pixel can independently be made to emit a mixture of multiple color primaries simultaneously and through a common pixel aperture. The methods described in Ref [3-5] make use the simultaneity and real-time controllability of the emissive SSL micro-scale pixel array to independently multiplex the multiple color primaries that can be emitted by each emissive pixel in the array to modulate any desired pixel value based on any synthesized reference gamut having any desired brightness and/or white point chromaticity. Since each pixel within the emissive micro-scale pixel array device described in Ref [3-5] possesses its own multi color primaries, each of the pixels of the described device can modulate its own color primaries simultaneously without the need to resort to time-sequential color multiplexing. Ref [3-5] also describes methods to modulate the display device emissive pixel array using video data that is based on any given reference gamut.

Similar to Ref [1-5], prior art Ref [6,11] make use of SSL fast switching and simultaneity to convert the native SSL color primaries of the display to a target gamut. Ref [6,11] describe a method to increase the display brightness by converting the display gamut into a target gamut derived from processing the video frame pixels. Although the stated inventive objective of Ref [6,11] is to redefine the display color gamut according to the color distribution of the input video, there is no specific method described to calculate (or determine) the color distribution of the input video from the collective pixels' data of the frame.

Prior art Ref [7] describes methods for dynamically selecting a gamut mapping component for use in a color management system which transforms colors specified in the image data from one color space to another. The described methods includes generating predictions for use in selecting from multiple gamut mapping components, wherein the generated predictions are based on a predetermined gamut mapping preferences corresponding to one or more of the characteristics of the image data, then selecting one of the multiple gamut mapping components based on the prediction information. However, the method described in Ref [7] does not venture to predict the color distribution of the input video data and does not map the system gamut to a gamut that matches the input video gamut; rather, Ref [7] method predicts certain set of gamut characteristics then maps the gamut to one of predetermined set of gamut based on the selected characteristics. Furthermore, there are no indications that Ref [7] method can be used to dynamically adapt a display system gamut in real-time to match the video input color gamut.

Prior art Ref [8] describes methods to improve the precision of a color look-up table (LUT) that is used to transform from an input image's color space to a device-dependent (print engine) color space. The described methods includes parametric analysis of the input image to determine the distribution of color within the image color space, then selecting, based on the performed image analysis, a subset of parameters from a predefined set of parameters to be used in the transformation of the image color space using color LUT. Although Ref [8] describes methods in which color distribution of the input image are analyzed, the described methods are only parametric analyses that enable the selection of a predefined subset of parameters for a preset color mapping LUT. Therefore, the methods of Ref [8] cannot be used to determine the actual color distribution gamut associated with an input image. Furthermore, the parametric image analysis described in Ref [8] cannot be used to dynamically adapt a display system gamut to match the video input color gamut especially in real-time at the typical video frame update rates used in color displays.

Prior art Ref [9] describes methods for control of an LED-based LCD backlight. The described methods include calculating a set of virtual color primaries for a given image and processing the input image using a field sequential color control of the LED-based backlight of the LCD. The described methods for calculating the set of virtual color primaries include processing of display pixels' values to determine a "color bounding box" inside the point spread function of the backlight LED color gamut. The determined virtual gamut is then used to control the LED backlight LED brightness and color. The formulas used in Ref [9] to determine the bounding box containing the virtual color primaries include analysis of the intersections of multiple planes within the color space, which is then approximated using an ad hoc formula to simplify the analysis of the pixels' values. The methods described in Ref [9] are also used to control an LED-based backlight comprising multiple segments illuminated by an array of LED sources. The methods used in Ref [9] for analysis of the pixels' data analysis to determine the virtual color primaries bounding box are rather simplistic and not likely to lead to much of a gamut reduction gain except possibly if the backlight segments are small enough to take advantage of possible color correlation of spatially adjacent pixels.

It is therefore the objective of this invention to introduce a dynamic gamut display system that encompasses analytical and computationally efficient methods for determining the color gamut content of a video frame, then to use these methods to adapt the display color gamut and to modulate adapted pixel values in real-time at the typical video frame rates. Another objective of this invention is to introduce methods for making use of the dynamic gamut gain to realize increased brightness, increased color dynamic gain, reduced power consumption, and reduced data interface and processing bandwidth for the display. It is also the objective of this invention to introduce methods for making use of the dynamic gamut gain to realize reduction in the video transfer bandwidth, which can be also realized as a data transfer bandwidth reduction at the video distribution headend. Additional objectives and advantages of this invention will become apparent from the following detailed description of a preferred embodiment thereof that proceeds with reference to the accompanying drawings.

BRIEF DESCRIPTION OF THE DRAWINGS

In the following description, like drawing reference numerals are used for the like elements, even in different drawings. The matters defined in the description, such as detailed construction and elements, are provided to assist in a comprehensive understanding of the exemplary embodiments. However, the present invention can be practiced without those specifically defined matters. Also, well-known functions or constructions are not described in detail, since they would obscure the invention with unnecessary detail. In order to understand the invention and to see how it may be carried out in practice, a few embodiments of it will now be described, by way of non-limiting example only, with reference to accompanying drawings, in which.

DETAILED DESCRIPTION OF THE PREFERRED EMBODIMENTS

Overview

Figure 1:
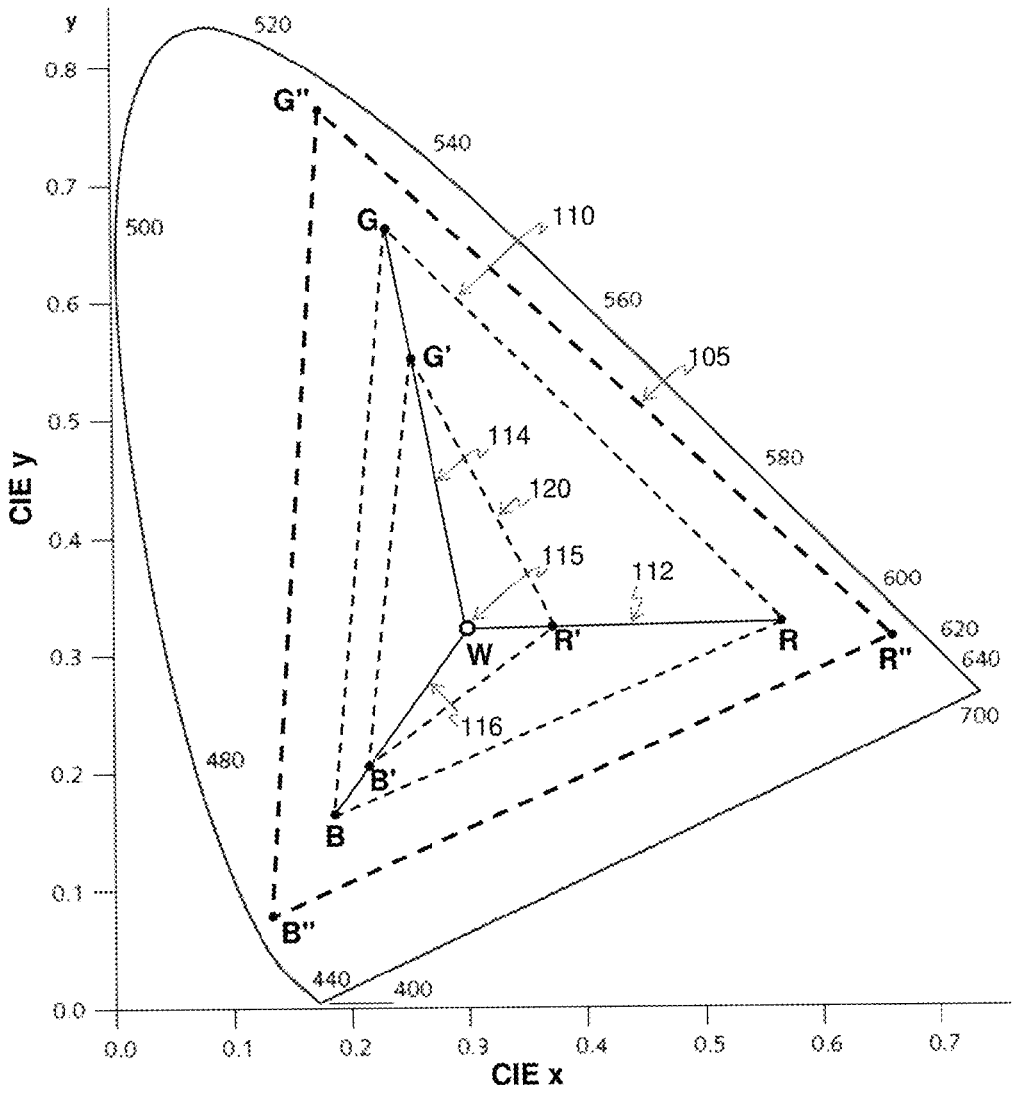
FIG. 1 illustrates the underlying concept of the dynamically adapted gamut of this invention.

Current display systems (such as LCD, OLED, LCOS or DLP) use a single (and fixed) color gamut, typically the HDTV or NTSC color gamut as a reference gamut, at all times. In recent SSL based display systems, devices such as light emitting diodes (LEDs) or laser diodes (LDs) are used to generate the display color primaries specified in the reference gamut standard Ref [1-5]. In these SSL-based display systems, the image being shown on the display typically uses only a small portion of the reference gamut color primaries, while a fair amount of processing power and brightness are being wasted on colors that are never displayed. The dynamic gamut system of this invention describes methods for dynamically adapting the color gamut of the SSL-based display to the frame image content color gamut. By adapting the color gamut of the display to the frame's pixels color content, all of the available brightness can be "folded" into a smaller, brighter gamut that is better matched to the frame image being displayed Ref [2]. Alternatively, the display brightness can be kept at a desired level, and the brightness gain achieved by the dynamic gamut of this invention would be traded for reduced power consumption, which is a critical design parameter for mobile displays. In addition, it is noted that the color gamut occupancy (or utilization) of any given frame color content is typically a fraction of the reference gamut; as a result of the reduced size gamut of this invention, the frame's pixels contents of each of the reduced size gamut color primaries either can be expressed using the same number of bits for each color or the color representation precision (or dynamic range) of the display or can be maintained using a reduced number of bits to represent each of the frame's pixels gamut color primaries content. In one embodiment of this invention, the display color dynamic range would proportionally increase with the reduced size of the adapted display gamut because the number of bits used for expressing the frame's pixels color primaries content is kept the same as that representing the pixels' color content of reference gamut color primaries. In an another embodiment of this invention, the color dynamic range of the display is kept at the same performance level, and the frame's pixel content of the reduced size gamut color primaries are expressed in fewer number of bits, thus reducing the size of the frame data which would result in a proportional reduction in the display processing resources cost and power consumption. Another benefit of the reduced frame data size of the latter embodiment of this invention is a commensurate reduction in the display system video interface data rate, which could be used to realize proportional video interface data bandwidth reduction. Additional benefits of the embodiment of this invention will be become more apparent from the following discussion and accompanied drawings.

Adapting the display color gamut to the frame's pixel's color content is made possible by the methods of this invention in which the frame's pixel's values representing each pixel's content of the display reference gamut color primaries are processed to derive a set of gamut metrics that are indicative of the frame's pixel's color content distribution (or spread) around the white point selected for the display. The derived gamut metrics are used to calculate a set of scale factors to be used by the SSL-display to adjust its color gamut and the frame's pixel's values, reflecting the pixel's color content of the reference gamut that are mapped to a new set of values reflecting the pixel's color content of the display adapted gamut. In the embodiment in which the display color dynamic range is maintained at the same value, the mapped pixel values are expressed at a color precision value that reflects the maintained color dynamic range. As a result, the number of bits representing the frame's pixel's color content would be reduced in proportion with the reduced size of the adapted display gamut.

The methods of the invention used to derive an adapted gamut and to map the frame's pixel's values to that adapted gamut can be implemented as an apparatus that either can be collocated or embedded within the display or can be remotely located. In the former case, methods of the invention can be used to realize multiplicity of benefits, including; increased display brightness, increased color dynamic range and reduced power consumption. In the latter case, in addition to all of the realized benefits of this invention at the display side, a commensurate reduction in size of the video data interface bandwidth can be realized at the video transmission (or distribution) headend.

To better explain the benefits that can be realized by the dynamic gamut methods of this invention, it is necessary to describe the manner in which the dynamic gamut display system of this invention dynamically synthesizes the three color primaries R, G, and B, Ref [1-6]. To synthesize the R primary, for example, all three SSL sources used in the display system are turned on at some pre-determined ratio to realize the R color primary specified by the HDTV color gamut standard. This ratio would be dominated by the red SSL source, with the green and blue SSL sources contributing only minor amounts. When the green and blue SSL sources are turned on for a longer time period, the R primary would be brighter, but the CIE [x, y] chromaticity point of the R primary would move closer to the white point. On a frame image content that does not need the full HDTV Red, like perhaps a greenish scene, it would be preferable to move the R primary closer to the white point, if possible, to get the increased brightness with minimal effect on the image.

General Concepts

The present invention makes use of some well-known techniques in the display systems pertaining to color space management, which are defined herein for completeness.

Color space conversion—Color displays' video data input is typically comprised of a serial stream of data packets whereby each data packet specifies the pixel's content of a reference color gamut. Examples of a reference gamut include HDTV gamut and NTSC gamut. A typical color display has a native color gamut that is determined by the color primaries of the display color filters, for example LCD, or color wheel based displays. In SSL-based displays, the display native gamut is defined by the color primaries of the display SSL sources. Well known color space conversion Ref [13] techniques are typically used to convert the video input data from the reference color gamut space to the display color gamut space. For example, the RGB pixel values specified using a set of source color primaries ($R_s$, $G_s$, $B_s$) can be transformed to a destination the color primaries ($R_d$, $G_d$, $B_d$) using the following 3×3 linear matrix:

$$\begin{bmatrix} R_d \\ G_d \\ B_d \end{bmatrix} = \begin{bmatrix} a & b & c \\ d & e & f \\ g & h & h \end{bmatrix} \cdot \begin{bmatrix} R_s \\ G_s \\ B_s \end{bmatrix}$$

Details

Multiple embodiments of the present invention are described herein with accompanying drawings to demonstrates methods and applications of adapting an SSL-display color gamut to match that of the frame pixels' color distribution. The embodiments described herein are by no means limiting, and the present invention can be implemented through different embodiments, such as for example, in conjunction with either SSL-based spatially modulated projection displays such as those described in Ref [1,2], SSL-based emissive micro-pixel array devices such as those described in Ref [3-5], SSL-based matrix backlight for LCD such as those described in Ref [9] or SSL-based pixelated backlight for OLED. The embodiments described herein are by no means limiting in terms of the benefits of the present invention that can be realized through different embodiments of possible applications, such as for example, to realize either increased brightness, increased color dynamic gain, reduced power consumption, and reduced data interface and processing bandwidth at the display side or a reduced data transfer bandwidth at the video distribution headend. The presentation of this embodiment serves to illustrate a practical implementation of the invention, but it can be modified or optimized without departing from the intended scope of this invention.

The typical color content of the digital video input to displays could vary significantly from frame to frame. As a result, the fixed color gamut modulation capabilities of conventional displays are mostly wasted, leading to unnecessary increase in the display power consumption and unrealized performance gains. In order to eliminate the wasted display capabilities and realized multiplicity of other possible performance gains, in the dynamic gamut display system described herein, the color gamut of each video frame or sub-region of the video frame is calculated in real-time; for example each 16.7 msec for 60 Hz video frame input rate, the color gamut primaries of the display are adapted to synthesize the calculated gamut color primaries, and the input video frame pixel values are converted from the video input reference gamut to the adapted frame gamut. As the video frame pixels' data are being loaded into memory of the dynamic gamut display system of this invention, the pixels' values are processed in real-time to calculate a set of metrics that represent the color distribution gamut of the processed frame's pixels. The calculated metrics are then used to determine the frame gamut to which the frame pixels' values would be converted before being provided to the display. The calculated metrics are also used to determine a set of gamut scale factors which are provided to the display to synthesize the frame adapted gamut color primaries. With the converted frame pixels values and gamut scale factors provided by the dynamic gamut system of this invention, the display synthesizes only the adapted color gamut which is matched to the converted frame pixels values color distribution.

FIG. 1 illustrates the underlying concept of the dynamically adapted gamut of this invention. FIG. 1 shows three sets of gamut color primaries; namely, the native gamut 105 of the display with the color primaries (R",G",B"), the HDTV gamut 110 with the color primaries (R,G,B) (herein referred to as the "reference gamut"), and the frame adapted gamut 120 with the color primaries (R',G',B') (herein referred to as the "adapted gamut"). In FIG. 1, the ranges of possible values for the adapted gamut 120 color primaries (R',G',B') are designated as 112, 114, and 116 lines; respectively, each line extending from the display white point 115 to the reference gamut 110 color primaries (R,G,B). Each of the frame adapted gamut 120 color primaries (R',G',B') has an CIE [x,y] chromaticity point that would lie somewhere on the respective 112, 114, and 116 lines between the white point 115 and the respective reference gamut 110 color primaries (R,G,B). In one embodiment of this invention, the frame adapted color primaries (R',G',B') can be at any point on the respective 112, 114, and 116 lines between white point 115 and the respective reference gamut 110 color primaries (R,G,B). In another embodiment of this invention, the frame adapted gamut 120 color primaries (R',G',B') can be a set of discrete points on the respective 112, 114, and 116 lines between white point 115 and the respective reference gamut 110 color primaries (R,G,B). In the following description of the various embodiments of the dynamic gamut display system of this invention, the video input to the display system, which can be HDTV gamut or any other specified color gamut such as NTSC gamut, for example, would be referred to as the RGB gamut and the dynamically adapted gamut of this invention would be referred to as the R'G'B' gamut.

Dynamic Gamut System 200—

Figure 2:
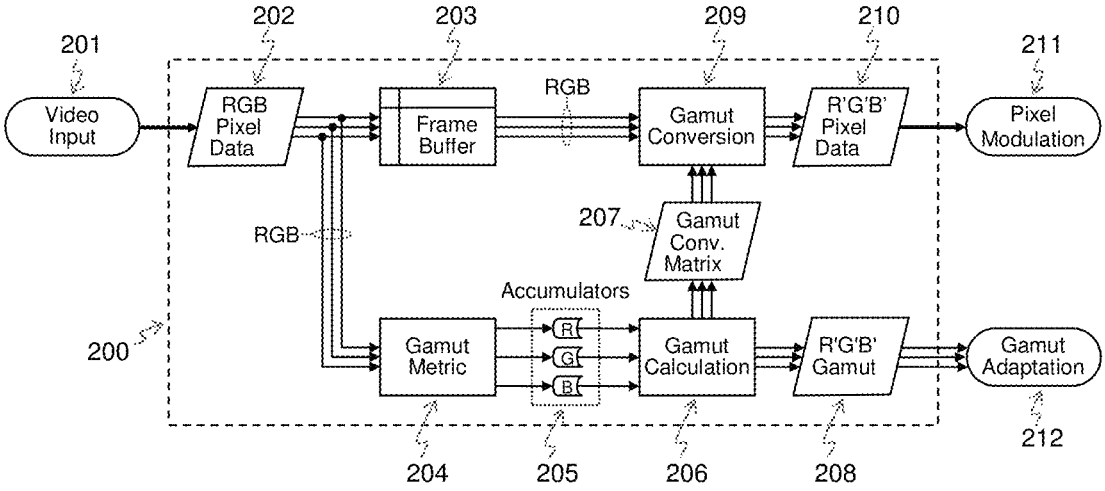
FIG. 2 illustrates a block diagram of the dynamic gamut system of this invention.

FIG. 2 illustrates a block diagram of the dynamic gamut system 200 of this invention. As illustrated in FIG. 2, the dynamic gamut system 200 accepts the video input data 201 and outputs the adapted gamut 208 and the converted pixels' data 210 to the display. The dynamic gamut system 200 of FIG. 2 would supplement the conventional video image processing of a display in order to realize the dynamic gamut display system of this invention. It should be noted that a prerequisite for the realization of the dynamic gamut display system of this invention is that the gamut of the display can be readily adjusted in real-time on a frame by frame basis. Although such a capability may not be readily feasible in display systems that use fixed color filters to define the display operational gamut (such as color-filter based LCD and OLED, for example), in SSL-based displays such as those described in Ref [1-5], the operational display color gamut can be readily adjusted in real-time at each video frame interval, and such are good candidates for pairing with the dynamic gamut system 200. Accordingly, the preferred embodiment of the dynamic gamut system 200 of this invention is its application as a supplement to SSL-based display capable of adapting its color gamut in real-time such as, but not limited to, those described in Ref [1-5]. The dynamic gamut system 200 either can be a video processing module that is external to the SSL-display or can be as a video frontend processing module that is embedded within the display itself. The dynamic gamut system 200 can be implemented either in high speed digital image processing logic as a dedicated application specific integrated circuit (ASIC) or as image processing software running on a high speed digital signal processor.

As illustrated in FIG. 2, the dynamic gamut system 200 is comprised of five functional blocks; namely, the frame buffer 203, the frame gamut metric calculation block 204, the gamut metrics accumulators block 205, the adapted gamut calculation block 206 and the gamut conversion block 209. At a high level the dynamic gamut system 200 would process the frame pixels' data to calculate the frame gamut 120, then convert the video frame pixels' data from the input reference gamut 110 to the adapted frame gamut 120 and provide the adapted color primaries to the display. Referring to FIG. 2, the video input data 201 comprising the RGB data of video frame pixels 202 is processed as each pixel values enter the frame buffer 203 in order to generate a set of gamut metrics 204 for each pixel that entered the frame buffer 203. The calculated gamut metrics for each pixel are then processed by the three accumulators 205 to calculate a set gamut metrics for the entire video frame. The calculated frame gamut metrics are then processed by the gamut calculation block 206 to generate the set of gamut scale factors 208, which are provided to the display for adapting its operating color gamut primaries 212 from the display native color gamut 105 to the frame adapted color gamut 120. Based on the frame gamut metrics calculated by the accumulators 205, the gamut calculation block 206 also calculates a 3×3 gamut conversion matrix 207 that is coupled to the gamut conversion block 209, which in turn retrieves the frame pixel data from the frame buffer 203 and converts pixel values from the video input reference gamut 110 to the frame adapted gamut 120. The gamut conversion block 209 then outputs the converted frame pixels data 210 to the display for pixel modulation 211.

In the described embodiment of this invention the dynamic gamut system 200 of this invention, illustrated in FIG. 2, could be collocated with the display as a supplementary video processing module either embedded in or external to the SSL-based display it supports. In an alternative embodiment of this invention, the functional processing capabilities of the dynamic gamut system 200 illustrated in FIG. 2 would be performed remotely as a supplementary processing to the video encoding typically performed at the video transmission headend site, and its output provided to a multiplicity of displays at the receiving end of a video transmission media, such as a cable network, a wireless network, the internet, a compact disc (CD) or a flash memory module. In the latter embodiment of this invention, the video data interface bandwidth reduction benefits (explained in a following paragraph) of the dynamic gamut system 200 can be also still be realized even when the display at the receiving end of the media does not possess the capabilities of real-time color gamut adaptation by incorporating means at the receiving end of the media, for example, the video set-top box, to convert the received adapted gamut frame pixels data back to the reference gamut which can be provided as a standard video data that can be accepted by a conventional display.

In the described embodiment of this invention, the dynamic gamut processing, illustrated in FIG. 2, would generate one dynamically adapted gamut per video frame. In an alternative embodiment of this invention, the dynamic gamut processing, illustrated in FIG. 2, would generate multiple dynamically adapted gamuts per video frame, whereby each of said dynamically adapted gamut is used in conjunction with a sub-region of the video frame; herein referred to as "sub-frame". In this case, the dynamic gamut processing, illustrated in FIG. 2, would be the same, except that each sub-frame is processed separately in order to generate a dynamically adapted sub-frame gamut for each sub-region of the video frame. Also in this case, the sub-region of the video frame defining each sub-frame can be a priori defined, derived using processing external to the dynamic gamut processing illustrated in FIG. 2, or derived from the dynamic gamut processing itself. The method for defining the sub-frames gamut adaptation will be described in a following paragraph.

The preceding discussion described a multiplicity of possible implementation embodiments of the dynamic gamut display system of this invention, including embodiments in which the dynamic gamut processing functions illustrated in FIG. 2 could be embedded within or collocated with the display or remotely located as a video encoding function at the video transmission headend. In other described embodiments of the dynamic gamut display system of this invention, the dynamic gamut processing functions illustrated in FIG. 2 are used to adapt the gamut once each video frame or alternatively once for each sub-frame whereby said sub-frame can be fixed in size a priori and can be changed based on an external input or can be adaptively determined by the dynamic gamut display system. In other embodiments, the dynamic gamut display system of this invention is used in conjunction with a SSL-display which possesses the capabilities to adjust its operation color gamut in real-time. Yet in other embodiments, the dynamic gamut display system of this invention is used in conjunction with a conventional display located at the receiving end of a video transmission media after being augmented with a capability to convert the video data output from the adapted frame gamut to the original reference color gamut. In these embodiments, as well as other embodiments described herein, the dynamic gamut display system of the invention will synonymously be referred to as the dynamic gamut system 200, with the intent that when either term is used, it is meant to refer to the functional processing elements of the dynamic gamut display system of the invention illustrated in FIG. 2.

Referring to FIG. 1 and FIG. 2, the input video data 201 to be displayed is assumed to come into the dynamic gamut system 200 in RGB color space representation after the appropriate de-gamma is performed in order to linearize the pixels' values and to possibly expand the pixel values bit word length to achieve higher internal processing precision and improve the pixel data color precision representation dynamic range. As each pixel is stored in the frame buffer 203, it is also sent through the gamut metric processing block 204 that calculates a set of metrics that represent the pixels' color content along the three respective lines 112, 114, and 116 extending from white point 115 to the respective reference gamut 110 color primaries (R,G,B). The gamut metric block 204 will output three different metrics for each processed pixel after each metric is integrated over the entire frame by the respective element of the metric accumulator block 205 to produce a set of three metric values that represent the color distribution of the frame pixels within the reference gamut 110.

After the entire frame has been loaded into the frame buffer 203, the frame gamut metric values for each color primary generated by the metric accumulator block 205 are sent to the frame gamut calculation block 206 which calculates a set of scale factors 208 to be used to convert the display native gamut 105 color primaries (R",G",B") to the frame adapted gamut 120 color primaries (R',G',B'). The calculated gamut scale factors 208 are sent to the display to synthesize the adapted gamut using its own native SSL color gamut 212.

The gamut calculation block 206 also uses the frame gamut metric values provided by the metric accumulator block 205 to calculate the 3×3 conversion matrix 207, which is provided to the gamut conversion block 209. In turn, the gamut conversion block 209 would retrieve the frame pixels' RGB values from the frame buffer 203 and convert the pixel values from the frame reference gamut 110 to the frame adapted gamut 120 and would provide the converted R'G'B' pixels' data 210 to the display for pixel modulation 211. The two outputs 208 and 210 of the dynamic gamut system 200 would typically be multiplexed together with video frame synchronization data that would be provided to the display. At the display side, the display's gamut primaries would be adapted 212 to synthesize the frame gamut 120 color primaries (R',G',B'), and the converted R'G'B' pixels' data 210 would then be used to modulate the adapted gamut 120 color primaries (R',G',B') in order to generate the pixel modulated frame image 211.

Gamut Metric 204—

As explained earlier, the dynamic gamut system 200 processes the frame pixels' data 202 to determine a color gamut that matches the color occupancy of the frame pixels. In order to achieve this objective, the gamut metric bock 204 of the dynamic gamut system 200 processes the frame pixels' data 202 to calculate a set of gamut metrics that represent the color content of each of the frame's pixels along the three respective lines 112, 114, and 116 extending from white point 115 to the respective reference gamut 110 color primaries (R,G,B). The following discussion describes the gamut metric of the dynamic gamut display system of this invention which is used to determine a frame adapted gamut that matches the frame pixels' color content.

Figure 3:
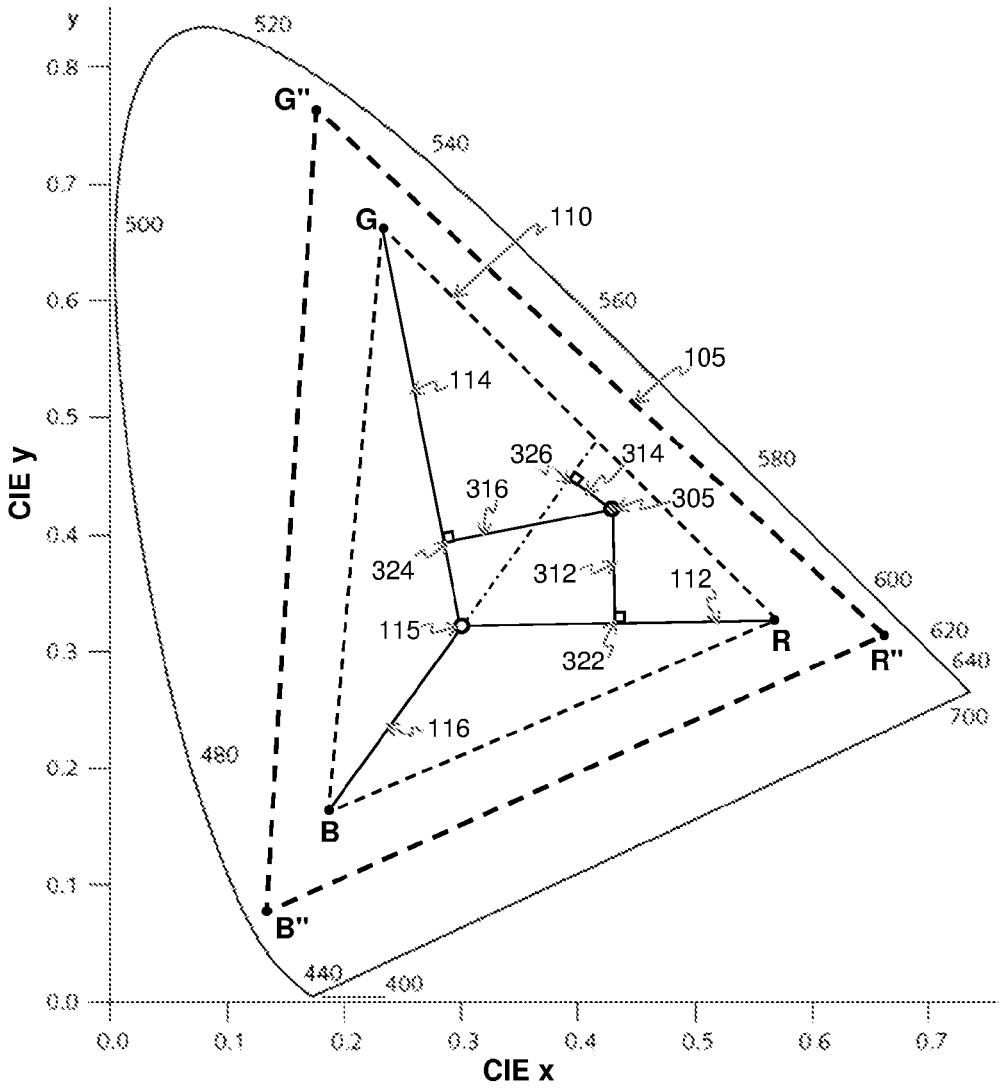
FIG. 3 illustrates the method used for calculating the gamut metrics of the dynamic gamut display system of this invention.

FIG. 3 illustrates the method used for calculating the gamut metrics of the dynamic gamut display system of this invention. In order to avoid introducing color artifacts, the gamut metrics of the dynamic gamut display system of this invention are based on the "minimum distances" 312, 314 and 316 from the frame's pixels' CIE [x, y] chromaticity position 305 to the set of lines RW 112, GW 114 and BW 116 extending from the white point 115 to the R, G and B color primaries of the video reference gamut 110; respectively. It should be noted that in FIG. 3, the minimum distances 312, 314 and 316 of the arbitrary pixel position 305 are shown after the pixel's RGB values were converted into a CIE [x, y] chromaticity values and plotted relative to the CIE [x, y]chromaticity axes as illustrated in FIG. 3. In the processing performed by the gamut metric block 204 of the dynamic gamut system 200, the minimum distances 312, 314 and 316 to the lines RW 112, GW 114 and BW 116 are used to identify the CIE [x, y] chromaticity coordinate values of their intersect points 322, 324 and 326 with the lines RW 312, GW 314 and BW 316; respectively. For each of the frame's pixels, the distances from the intersect points 322, 324 and 326 to the white point 115 would be converted to a normalized value, designated as $M_R$, $M_G$ and $M_B$; respectively, which are based on the respective intersect points 322, 324 and 326 locations on the lines RW 112, GW 114 and BW 116. The normalization of the distances $M_R$, $M_G$ and $M_B$ of the intersect points 322, 324 and 326 to the white point 115 is based on normalizing the CIE[x, y] chromaticity position of the white point 115 to a value 0.0, normalizing the video reference gamut 110 color primaries' (R,G,B) CIE [x, y]chromaticity positions to values 1.0, and linearly normalizing the values of points in between along each of the set of lines RW 112, GW 114 and BW 116 to values in (0,1) range. As an example, a minimum distance intersect point that lies halfway between the R primary and white point 115 would have $M_R$=0.5; likewise, an intersect point two-thirds of the way from white point 115 to R would have $M_R$=0.66667 and an intersect point that is one quarter of the way from white point 115 to R would have $M_R$=0.25.

As illustrated in FIG. 3, the position of any of the frame's pixels' as represented by the CIE [x, y]chromaticity point 305, for example, within the video reference gamut 110 can be sufficiently represented by the CIE [x, y] chromaticity position of the white point 115 and only two of the reference gamut 110 color primaries (R,G,B) CIE [x, y] chromaticity positions. For example, as illustrated in FIG. 3, the CIE [x, y] chromaticity position 305 can be sufficiently represented by the CIE [x, y] chromaticity position of the white point 115 and CIE [x, y] chromaticity positions of the reference gamut color primaries coordinates R and G only. That is to say the CIE [x, y] chromaticity position 305 can be sufficiently represented by the two minimum distances 312 and 316 to the lines RW 112 and GW 114. Hence, the normalized values $M_R$, $M_G$ and $M_B$ (or the values themselves) are assigned a value 0.0 when their respective intersect points 322, 324 and 326 locations on the lines RW 112, GW 114 and BW 116 lie beyond the white point 115 CIE [x, y] chromaticity position. For example, the normalized metrics $M_R$, $M_G$ and $M_B$ representing frame pixel 305 would have the values 0.5, 0.2 and 0.0; respectively. Thus at least one of the normalized metrics $M_R$, $M_G$ or $M_B$ will always be 0.0.

The implementation of the described gamut metric can be reduced to the following equations that convert each of the frame's pixels (R,G,B) input values, such as the example pixel 305, and produce the normalized gamut metrics $M_R$, $M_G$ and $M_B$ as follows:

$$M_R = \frac{a_R \cdot R + b_R \cdot G + c_R \cdot B}{d \cdot R + e \cdot B + f \cdot G} - h_R \quad \text{Eq. 1a}$$

$$M_G = \frac{a_G \cdot R + b_G \cdot G + c_G \cdot B}{d \cdot R + e \cdot B + f \cdot G} - h_G \quad \text{Eq. 1b}$$

$$M_B = \frac{a_B \cdot R + b_B \cdot G + c_B \cdot B}{d \cdot R + e \cdot B + f \cdot G} - h_B \quad \text{Eq. 1c}$$

The above set of equations would be used by the gamut metric block 204 to generate the three metric values ($M_R$, $M_G$, $M_B$) for every pixel in the frame, and the values of the metric $M_R$ coefficients $(a, b, c, d, e, f, h)_R$, are derived as follows, assuming the frame pixel RGB values are first converted to CIE XYZ using the commonly known color-space conversion equation (Ref. [13]):

$$\begin{bmatrix} X \\ Y \\ Z \end{bmatrix} = \begin{bmatrix} \hat{a} & \hat{b} & \hat{c} \\ \hat{d} & \hat{e} & \hat{f} \\ \hat{g} & \hat{h} & \hat{i} \end{bmatrix} \cdot \begin{bmatrix} R \\ G \\ B \end{bmatrix} \quad \text{Eq. 2}$$

It should be noted that the conversion of the frame pixels' values from RGB to XYZ color spaces is dependent on the desired display system's white point 115 RGB values ($R_W$, $G_W$, $B_W$), and as such the conversion 3×3 matrix in Eq. 2 would need to be adjusted when the operating white point 115 of the display system is changed. The metric $M_R$ coefficients $(a, b, c, d, e, f, h)_R$ for the Red primary in Eq. 1a are then given by the following equations, where $[x_R, y_R]$ is the CIE [x,y] chromaticity point for the reference gamut 110 R primary and $[x_w, y_w]$ is the selected white point 115 CIE [x,y] chromaticity point:

$$a_R = \frac{\hat{a} \cdot (x_R - x_W) + \hat{d} \cdot (y_R - y_W)}{(x_R - x_W)^2 + (y_R - y_W)^2} \quad \text{Eq. 3a}$$

-continued $$b_R = \frac{\hat{b}\cdot(x_R - x_W) + \hat{e}\cdot(y_R - y_W)}{(x_R - x_W)^2 + (y_R - y_W)^2} \quad \text{Eq. 3b}$$

$$c_R = \frac{\hat{c}\cdot(x_R - x_W) + \hat{f}\cdot(y_R - y_W)}{(x_R - x_W)^2 + (y_R - y_W)^2} \quad \text{Eq. 3c}$$

$$d = \hat{a} + \hat{b} + \hat{c} \quad \text{Eq. 3d}$$
$$e = \hat{d} + \hat{e} + \hat{f}$$
$$f = \hat{g} + \hat{h} + \hat{i}$$

$$h_R = \frac{x_W\cdot(x_R - x_W) + y_W\cdot(y_R - y_W)}{(x_R - x_W)^2 + (y_R - y_W)^2} \quad \text{Eq. 3e}$$

The equations for the coefficients for the G and B primaries are similar. Note that the equations for the metrics coefficients (a, b, c, d, e, f, h)$_{R,G,B}$ depend on the selected display system's white point 115 CIE [x,y] chromaticity and need to be recalculated only when the operating white point 115 of the display system is changed.

The above gamut metric equations would be calculated three times (once for R, G, and B) for every pixel of every frame. In total, the ($M_R$, $M_G$, $M_B$) metrics calculation would require 12 multiplications, 3 divisions, and 11 additions per pixel. If the division is minimized, the metric calculation would require 15 multiplications, 1 division, and 11 additions per pixel. For an HD (1280×720) display, for example, the metric calculation requires 14 million multiplications, 1 million divisions, and 10 million additions per frame.

Referring to FIG. 2, in one embodiment of this invention, the results of the metric calculation are integrated in the sets of running accumulators 205 for each color primary. As the pixels are processed by the gamut metric block 204 to produce the ($M_R$, $M_G$, $M_B$) values, the following two metrics are generated for the Red primary (the equations for the B and G primaries are similar):

$$\tilde{M}_R(n) = \frac{n-1}{n}\tilde{M}_R(n-1) + \frac{1}{n}M_R(n) \quad \text{Eq. 4a}$$

$$\hat{M}_R(n) = \frac{n-1}{n}\hat{M}_R(n-1) + \frac{1}{n}\left|M_R(n) - \tilde{M}_R(n)\right| \quad \text{Eq. 4b}$$

Where n represents the value of a running counter that counts the number of pixels entering the accumulators 205. The metrics ($\tilde{M}_R$, $\tilde{M}_G$, $\tilde{M}_B$) would represent the running mean value of the normalized intersect points distances ($M_R$, $M_G$, $M_B$), and the metrics ($\hat{M}_R$, $\hat{M}_G$, $\hat{M}_B$) would represent the running spread values around the values ($\tilde{M}_R$, $\tilde{M}_G$, $\tilde{M}_B$). The set of metrics ($\tilde{M}_R$, $\tilde{M}_G$, $\tilde{M}_B$) and ($\hat{M}_R$, $\hat{M}_G$, $\hat{M}_B$) are used by the gamut calculation block 206 as described in the following paragraph to determine the color primaries of the adapted gamut Gamut Calculation 206—

Referring to FIG. 2, after the frame's pixels' values have been loaded into the frame buffer 203 and the loaded pixels have been processed by the gamut metric block 204, the gamut metrics ($\tilde{M}_R$, $\tilde{M}_G$, $\tilde{M}_B$) and ($\hat{M}_R$, $\hat{M}_G$, $\hat{M}_B$), generated by the accumulators 205 once their pixel counter reaches its designated upper value n=N, would be used by the frame gamut calculation block 206 to generate a set of gamut scale factors ($F_R$, $F_G$, $F_B$) as given by the following equation for the R primary (the equations for G and B are similar):

$$F_R = \text{Min}\{1(\tilde{M}_R(N) + \hat{M}_R(N))\} \quad \text{Eq. 5}$$

The set of gamut scale factors ($F_R$, $F_G$, $F_B$) would represent the spread of the frame's pixels' chromaticity values around the white point 115. The set of gamut scale factors ($F_R$, $F_G$, $F_B$) would be used to synthesize the adapted gamut 120 color primaries (R',G',B) using the display native gamut 105 color primaries (R",G",B") and to convert the frame pixels values to the adapted gamut 120 as to be explained in the following paragraphs.

In one embodiment, the dynamic gamut display system of this invention would adapt the display gamut to match each received video frame. In this case, the full count of frame pixels would be loaded into the frame buffer 203, and the upper value N of the pixels running counter of the accumulators 205 would reach the full pixel count of the video frame before the set of metrics ($\tilde{M}_R$, $\tilde{M}_G$, $\tilde{M}_B$) and ($\hat{M}_R$, $\hat{M}_G$, $\hat{M}_B$) are generated by the accumulators 205 and subsequently used by the frame gamut calculation block 206 to calculate the gamut scale factors ($F_R$, $F_G$, $F_B$). For example, for HD720 video frame the upper value N of the pixels running counter of the accumulators 205 would be set to a value N=1280×720=921,600 in order to generate a set of gamut scale factors ($F_R$, $F_G$, $F_B$) for each frame to be used to adapt the display gamut once every video frame. It should be noted that in this case, depending upon the processing throughput dedicated to the described processing, the size of the frame buffer 203 would be at least equal to the total number of bits representing the pixels of a full video frame. Furthermore, the dynamic gamut gain (to be described in the following paragraphs) would be less than the most that can be achieved, since the full frame pixels' color correlation is typically lower than the pixels' color correlation over a sub-region of a frame.

Figure 4A:
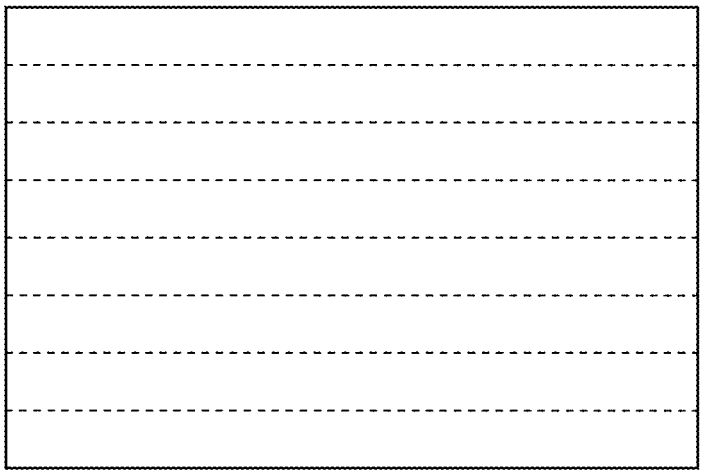
FIG. 4*a* illustrates an example of adapting the gamut over multiple equal size sub-regions of the frame of one embodiment of this invention.

In another embodiment, the dynamic gamut display system of this invention would generate one adapted gamut for each one of multiple sub-regions of the video frame. In this case, the upper value N of the pixels running counter of the accumulators 205 would represent the number of pixels included in each of one of multiple sub-regions of the video frame. FIG. 4*a* illustrates an example in which the full video frame is divided eight equal sub-regions, the gamut for each of which the dynamic gamut display system of this invention would generate a separately adapted gamut. In the case when an HD720 video frame is divided into eight sub-regions, the upper value of pixel counters of the accumulators 205 would be set to a value $$N = \frac{1280\times720}{8} = 115{,}200.$$

When the gamut metric accumulators 205 counters reach the sub-region pixel count value N, a set of gamut scale factors ($F_R$, $F_G$, $F_B$) would be sent to the gamut metric calculation block 206 and the pixels of that frame sub-region are moved from the frame buffer 203 to the gamut conversion block 209. It should be noted that in the case of this example, the size of the frame buffer 203 would decrease to one eighth of the buffer size needed when the gamut is adjusted every frame. As result of the decreased frame buffer size, the latency of the display system will also decrease proportionally. In addition, the dynamic gamut gain would also be higher since typically the pixels' color correlation is higher over a sub-region of a frame.

Figure 4C:
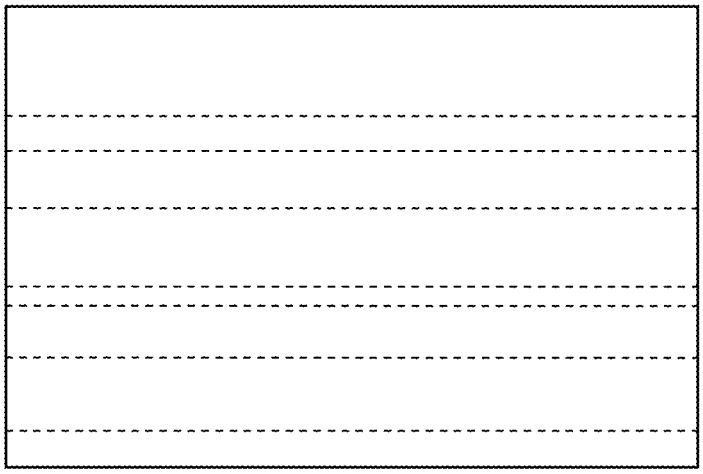
FIG. 4*c* illustrates an example of adapting the gamut over multiple unequal size sub-regions of the frame of one embodiment of this invention.
Figure 4B:
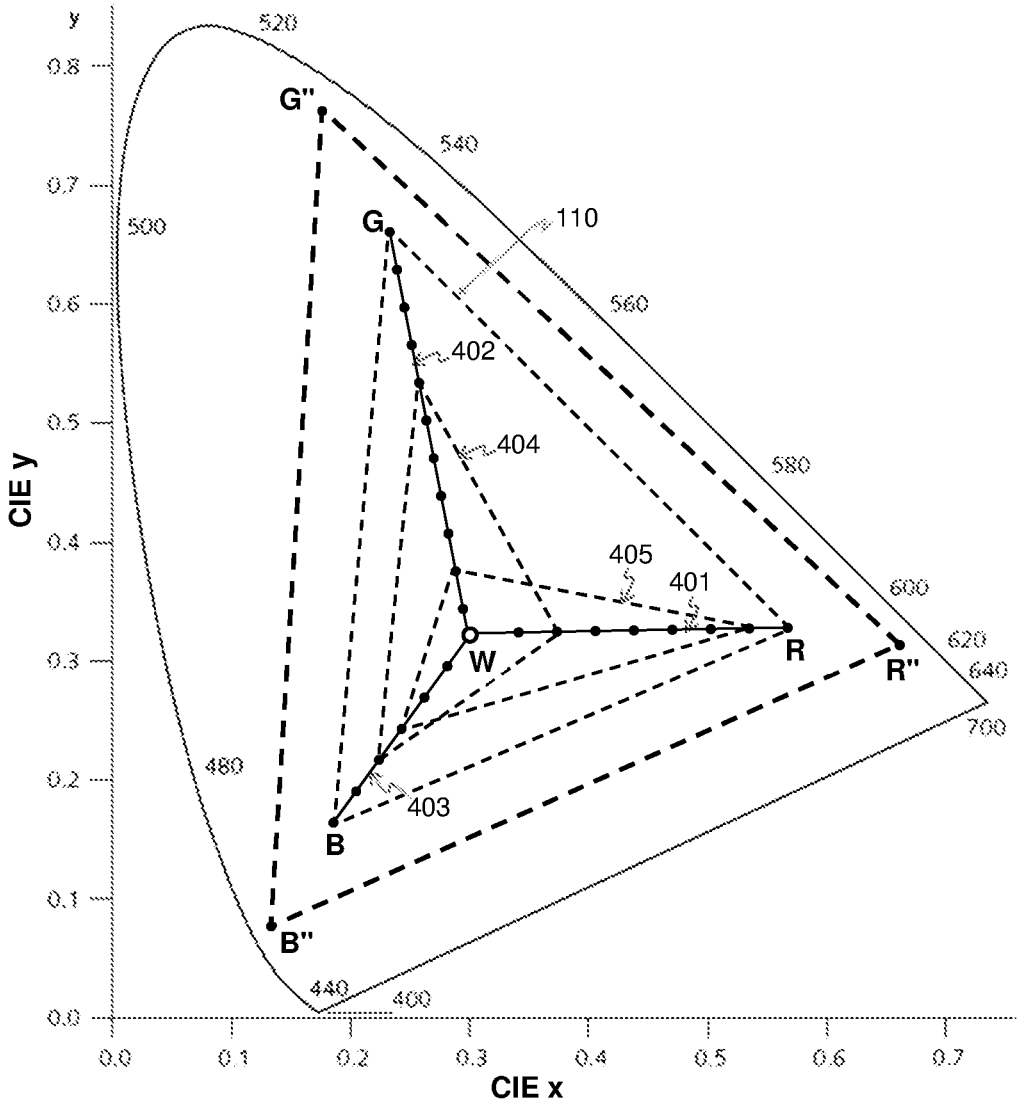
FIG. 4*b* illustrates an example of the discrete set of gamut primaries scale factors threshold values of one embodiment of this invention.

In another embodiment, the dynamic gamut display system of this invention would generate one adapted gamut for sub-regions of the video frame having a different gamut. In this case running values of the gamut metrics ($\tilde{M}_R(n)$, $\tilde{M}_G(n)$, $\tilde{M}_B(n)$)and ($\hat{M}_R(n)$, $\hat{M}_G(n)$, $\hat{M}_B(n)$) are sent directly to the frame gamut calculation block 206, which then calculates a running value of the set of scale factors ($F_R(n)$, $F_G(n)$, $F_B(n)$) and compares these valuesto a set of predefined thresholds. The set of predefined scale factor thresholds are values of the gamut primaries scale factors that would partition the set of lines RW 112, GW 114 and BW 116 extending from the white point 115 to the reference gamut RGB primaries into a set of discrete segments, for example 8, 16 or 32 segments. FIG. 4*b* illustrates an example of the discrete set of gamut color primaries scale factors threshold values of this embodiment and the resultant partition of lines RW 401, GW 402 and BW 403 extending from the white point W (115 in FIGS. 1 and 3) to the reference gamut RGB primaries; respectively, into multiple discrete segments. FIG. 4*b* also illustrates two examples of the adapted gamut (404 and 405) for the frame sub-regions generated by this embodiment. In this embodiment, an adapted gamut color primary scale factor $F_R$, $F_G$ or $F_B$ would be selected when the corresponding scale factor running values $F_R(n)$, $F_G(n)$ or $F_B(n)$ falls into a different discrete segment. When a color primary scale factor $F_R$, $F_G$ or $F_B$ is selected, the corresponding color primary running metric accumulator in the metric accumulator block 205 is reset, and the corresponding selected color primary scale factor is used to calculate an adjusted gamut for that sub-region of the frame. The result, illustrated in FIG. 4*c*, would be a gamut that is adapted in each one of multiple non-equal sub-regions of the frame, wherein the gamut is adapted adaptively to match the color gamut of that sub-region of the frame. In order to avoid rapid changes in the adapted gamut, a minimum number, for example equivalent to a few rows of frame pixels, of the running set of scale factors ($F_R(n)$, $F_G(n)$, $F_B(n)$) are processed after the corresponding running metric accumulator 205 is reset. The main advantage of this embodiment is that it would offer an increased dynamic gamut gain, since the gamut is adjusted based on pixels' color correlation within the corresponding sub-region of the frame, which is typically much higher than the color correlation over the entire frame. A reduced frame buffer size and processing latency are also offered by this embodiment, albeit dependent upon a selected maximum size for the frame sub-regions.

Gamut Conversion 209—

In the aforementioned embodiments of the dynamic gamut display system of this invention, the values of each of the three gamut scale factors ($F_R$, $F_G$, $F_B$) calculated by the gamut calculation block 206 would range from 0 to 1. A gamut scale factor of (1,1,1) is the full video reference RGB gamut 110, while a value of (0,0,0) is the white point 115. Referring to FIG. 2, the gamut scale factors ($F_R$, $F_G$, $F_B$) are used by the gamut calculation block 206 to generate the 3×3 gamut conversion matrix 207, which would be used by the gamut conversion block 209 to convert the pixel values stored in the frame buffer 203 from the reference gamut 110 RGB values to the adapted gamut 120 R'G'B' values 210, which are sent to the display. The gamut scale factors ($F_R$, $F_G$, $F_B$) are used by the gamut calculation block 206 to calculate the CIE [x,y] chromaticity of the adapted gamut 120 R'G'B' color primaries as follows:

$$x_{R'}=x_R F_R+x_W(1-F_R)\quad y_{R'}=y_R F_R+y_W(1-F_R)$$

$$x_{G'}=x_G F_G+x_W(1-F_G)\quad y_{G'}=y_G F_G+y_W(1-F_G)$$

$$x_{B'}=x_B F_B+x_W(1-F_B)\quad y_{B'}=y_B F_B+y_W(1-F_B) \qquad \text{Eq. 6}$$

Where [$x_R$, $y_R$],[$x_G$, $y_G$] and [$x_B$, $y_B$] are the CIE [x,y] chromaticity points of the reference gamut 110, [$x_{R'}$, $y_{R'}$], [$x_{G'}$, $y_{G'}$] and [$x_{B'}$, $y_{B'}$] are the CIE [x,y] chromaticity points of the adapted gamut 120 and [$x_W$, $y_W$] is the selected white point 115 CIE [x,y] chromaticity.

The three gamut scale factors ($F_R$, $F_G$, $F_B$) are used by the gamut calculation block 206 to create a 3×3 gamut conversion matrix 207 that is used by the gamut conversion block 209 to transform RGB pixels' values to R'G'B' pixels' values. First, the adapted gamut chromaticity coordinates calculated using Eq. 6 are transformed from XYZ to R'G'B' coordinates, then a conversion matrix 207 is calculated by the gamut calculation block 206 and sent to the gamut conversion block 209 to transform the RGB pixel values stored in the frame buffer 203 to R'G'B' pixel values as follows:

$$\begin{bmatrix} R' \\ G' \\ B' \end{bmatrix} = \begin{bmatrix} \alpha & \beta & \chi \\ \delta & \varepsilon & \phi \\ \varphi & \gamma & \eta \end{bmatrix} \cdot \begin{bmatrix} R \\ G \\ B \end{bmatrix} \qquad \text{Eq. 7}$$

The 3×3 conversion matrix 207 in Eq. 7 is a result of multiplying the 3×3 matrix that converts the pixel values from RGB to XYZ, which is calculated each time the white point 115 of the display system is changed, by the 3×3 matrix that converts the pixel values from XYZ to R'G'B', which is calculated each time the display gamut is to be adapted as explained earlier. The 3×3 conversion matrix 207 in Eq. 7 is used by the gamut conversion block 209 to convert the pixel values stored in the frame buffer 203 from the reference gamut RGB to the adapted gamut R'G'B' pixel values 210 to be provided to the display for pixel modulation 211. The gamut conversion processing for each pixel would require 9 multiplications and 6 additions. For a HD-720 (1280×720) dynamic gamut display system, the gamut conversion processing would require 8.3 million multiplications and 5.5 million additions per frame.

Gamut Adaptation 212—

Referring to FIG. 1, a typical SSL-based display system, such as those described in Ref [1-5], would maintain a set of scale factors that are used to synthesize the video reference gamut 110 color primaries (R,B,G) using the SSL-based display system native gamut 105 color primaries (R",G",B"), which are typically highly saturated and cover a much wider gamut than the video reference gamut 110. The set scale factors maintained by SSL-based display system, listed in Table 1, are typically values between 0 and 1 which are used to temporally multiplex the native gamut 105 color primaries (R",G",B") during the display modulation time interval $T_m$ in order to synthesize the reference gamut 110 color primaries (R,G,B) and the desired white point 115. In a typical SSL-based display system, such as those described in Ref [1-5], these scale factors are periodically updated to compensate for possible drifts in the chromaticity of the native gamut 105 SSL color primaries (R",G",B") in order to maintain the correct chromaticity in synthesizing the reference gamut 110 color primaries (R,G,B). As listed in Table 1, these scale factors are comprised of two types; namely, "Color" primaries scale factors and a "Gain" scale factor. Referring to Table 1, the set of Color scale factors are used to multiplex the native gamut 105 color primaries (R",G",B") to synthesize the reference gamut 110 color primaries (R,G,B) together with the Gain scale factor which is used to set the desired brightness for the display, Ref [1-5].

TABLE 1

| Native gamut to reference gamut scale factors | | | |
|---|---|---|---|
| Color | | | Gain |
| $R_{R''}$ | $R_{G''}$ | $R_{B''}$ | $S_{gain}$ |
| $G_{R''}$ | $G_{G''}$ | $G_{B''}$ | |
| $B_{R''}$ | $B_{G''}$ | $B_{B''}$ | |

An SSL-based display system would synthesize the reference gamut 110 color primaries (R,G,B) by scaling its native gamut 105 color primaries (R",G",B") SSL sources turn-on times (or duty cycle) while multiplexing these native color primaries together during the display modulation time interval $T_m$ as follows for synthesizing the reference gamut 110 Red color primary (the equations for G and B are similar):

$$T_{RR''}=T_m \cdot R_{R''} \cdot S_{gain}$$

$$T_{RG''}=T_m \cdot R_{G''} \cdot S_{gain}$$

$$T_{RB''}=T_m \cdot R_{B''} \cdot S_{gain} \qquad \text{Eq. 8}$$

Where $T_{RR''}$, $T_{RG''}$ and $T_{RB''}$ are the time durations during the display modulation time interval $T_m$, each of the three native gamut 105 color primaries R", G" and B" would be turned on; respectively, in order to synthesize the Red primary of the reference gamut 110. The turn-on durations ($T_{GR''}$, $T_{GG''}$, $T_{GB''}$) and ($T_{BR''}$, $T_{BG''}$, $T_{BB''}$) required to synthesize the Green and Blue color primaries; respectively, of the reference gamut 110 would be calculated using the scale factors listed in Table 1 and equations similar to Eq. 8. The SSL-based display brightness can be changed by changing the value of the scale factor $S_{gain}$ in Table 1, which as can be seen from Eq. 8, would accordingly change the display's native gamut 105 color primaries R", G" and B" turn-on time durations proportionally during the display modulation time interval $T_m$.

The SSL-based dynamic gamut display system of this invention would use a similar set of scale factors as in Table 1 plus the gamut adaptation scale factors ($F_R$, $F_G$, $F_B$) calculated by the gamut calculation block 206. As explained earlier, the gamut adaptation scale factors ($F_R$, $F_G$, $F_B$) are used to adapt the display color gamut to match the video frame gamut or sub-region gamut. The expanded set of scale factors used by the dynamic gamut display system of this invention are listed in Table 2.

TABLE 2

| Native gamut to adapted gamut scale factors | | | | |
|---|---|---|---|---|
| Color | | | Gain | Gamut |
| $R_{R''}$ | $R_{G''}$ | $R_{B''}$ | $S_{gain}$ | $F_R$ |
| $G_{R''}$ | $G_{G''}$ | $G_{B''}$ | $W_{gain}$ | $F_G$ |
| $B_{R''}$ | $B_{G''}$ | $B_{B''}$ | | $F_B$ |
| $W_{R''}$ | $W_{G''}$ | $W_{B''}$ | | |

In addition to the Color and Gain scale factors listed in Table 1, the set of scale factors used by the dynamic gamut system of this invention, listed in Table 2, includes the gamut adaptation scale factors ($F_R$, $F_G$, $F_B$) plus an additional Gain and Color scale factors; namely, $W_{gain}$ and ($W_{R''}$, $W_{G''}$, $W_{B''}$). The white gain scale factor $W_{gain}$ is added to keep the white brightness constant as the gamut is adapted. The white scale factors ($W_{R''}$, $W_{G''}$, $W_{B''}$) are the scale factors that would be needed to synthesize the display white point 115 from the three native gamut 105 color primaries (R",G",B"), not the three synthesized reference gamut 110 color primaries (R,G,B). The white scale factors ($W_{R''}$, $W_{G''}$, $W_{B''}$) are used for calculation only and would be updated by the dynamic gamut display system of this invention in real-time whenever the chromaticity of the display system native gamut 105 color primaries (R",G",B") are changed. It should be noted that the white scale factors ($W_{R''}$, $W_{G''}$, $W_{B''}$) can be calculated from the Color scale factors in Table 2, if adding memory to the display system for saving these scale factors is too costly. In effect, the dynamic gamut display system scale factors listed in Table 2 are what is needed to synthesize the reference gamut 110 color primaries (R,G,B) from the native gamut 105 color primaries (R",G",B") plus the calculated set of scale factors needed to adapt the gamut to match the frame gamut 120 color primaries (R',G',B'), while maintaining display system white point chromaticity and brightness.

The dynamic gamut display system would then adapt the gamut to match the frame gamut (R',G',B') 120 by scaling its native color primaries (R",G",B") 105 SSL sources turn-on times (or duty cycle) while multiplexing these color primaries together during the display modulation time interval $T_m$ as follows for synthesizing the adapted gamut 120 Red color primary (the equations for G and B are similar):

$$T_{R'R''}=T_m\{F_R \cdot R_{R''} \cdot S_{gain}+(1-F_R) \cdot W_{R''} \cdot W_{gain}\}$$

$$T_{R'G''}=T_m\{F_R \cdot R_{G''} \cdot S_{gain}+(1-F_R) \cdot W_{G''} \cdot W_{gain}\}$$

$$T_{R'B''}=T_m\{F_R \cdot R_{B''} \cdot S_{gain}+(1-F_R) \cdot W_{B''} \cdot W_{gain}\} \qquad \text{Eq. 9}$$

Where $T_{R'R''}$, $T_{R'G''}$ and $T_{R''B''}$ are the time durations during the display modulation time interval $T_m$ each of the three native gamut 105 color primaries R",G" and B" would be tuned on; respectively, in order to synthesize the Red primary of the adapted gamut 120. The turn-on times ($T_{G'R''}$, $T_{G'G''}$, $T_{G'B''}$) and ($T_{B'R''}$, $T_{B'G''}$, $T_{B'B''}$) required to synthesize the Green and Blue color primaries of the adapted gamut 120 would be calculated using the scale factors in Table 2 and equations similar to Eq. 9. The dynamic gamut display system brightness can be changed by changing the value of the gain scale factors $S_{gain}$ and $W_{gain}$ listed in Table 2, which as can be seen from Eq. 9, would accordingly change the display's native gamut 105 color primaries R",G"and B" turn-on time durations during the display modulation time interval $T_m$.

Dynamic Gamut Applications—

Increased brightness—The dynamic gamut display system of this invention has several applications. The first of such applications is the use of the dynamic gamut display system of this invention to increase the brightness of the display system. When, for example, the calculated scale factor $F_R$ for the adapted gamut 120 Red primary equals 1, indicating that the full value of the reference gamut 110 Red primary is needed for the adapted gamut, Eq. 8 and Eq. 9 would become identical and the resultant contribution of the reference gamut 110 Red color primary in the adapted gamut 120 would be the same. When the calculated scale factor $F_R$ for the adapted gamut 120 Red primary is less than 1, the contribution of the reference gamut 110 Red primary accordingly decreases, but a complementary ($1-F_R$), amount of the reference gamut 110 Red, Blue and Green primaries at the set white point 115 chromaticity balance are added simultaneously, resulting in a net increase in the total luminance contributed by the three native gamut 105 color primaries (R", G", B") during the display modulation time interval $T_m$, thus causing a proportional increase in the brightness associated with the adapted gamut 120 Red primary. Accordingly, one of the applications of the dynamic gamut display system is an increased brightness when compared to a display system with a gamut that is fixed at the reference video gamut 110.

Reduced power consumption—The increased brightness of the dynamic gamut display system of this invention can be traded for lower power consumption in applications in which the power consumption of the display is a paramount performance parameter, such as in mobile devices for example. In this case, the brightness increase due to gamut adaptation would be calculated Ref [2] and the scale factors $S_{gain}$ and $W_{gain}$ are then adjusted to proportionally reduce the turn-on durations ($T_{R'R''}$, $T_{R'G''}$, $T_{R'B''}$), ($T_{G'R''}$, $T_{G'G''}$, $T_{G'B''}$) and ($T_{B'R''}$, $T_{B'G''}$, $T_{B'B''}$), thus causing a proportional reduction in the display system power consumption.

Increased dynamic range—Referring to FIG. 2, it is noted that as a result of the dynamic adaptation of the display gamut, the adapted gamut 120 color primaries (R',G',B') would, in the average, be pulled-in closer toward the white point 115 as the gamut becomes smaller in size to match the frame gamut. Referring to FIG. 3, a typical pixel 305 RGB values would be represented using a given word length, which in most display system is 8 bits. When the adapted gamut 120 size becomes smaller than the video reference gamut 110, the pixel 305 R'G'B' values could still be represented by same size word length, even though the distances from the pixel 305 to the smaller size adapted gamut 120 color primaries (R',G',B') would have become smaller. As a result, if the pixel 305 R'G'B' values are kept represented by same size word length, for example 8 bits, the precision in synthesizing the pixel 305 color would increase proportionally. For example, if the adapted gamut 120 Red primary R' is pulled in halfway towards the white point 115, then the 256 quantization levels provided by an 8-bit representation of the pixel 305 Red primary R' value would offer half the quantization interval size, thus causing a proportional increase in the precision in synthesizing the pixel 305 Red primary R' value, which would equate to a proportional increase in the display dynamic range. Thus, since in average the adapted gamut 120 size would be smaller than the reference gamut 110, that difference would be mapped into a proportional increase in the dynamic range of the dynamic gamut display system of this invention.

Reduced interface & processing bandwidth—Since as noted the adapted gamut 120 color primaries (R',G',B') would typically be pulled-in closer toward the white point 115 as the gamut becomes smaller in size to match the frame gamut or sub-frame gamut, in keeping the same color precision (or display dynamic range), fewer bits would be required to express the adapted color primaries values of each pixel within the video frame. For example, if the adapted color primaries are pulled-in closer toward the white point 115 to result in a factor of 8 reduction of the distance from the video reference gamut 110 color primaries (R,G,B) to the white point 115, then only 5 bits would be needed to express pixels values in reference to the adapted gamut 120 color primaries (R',G',B") instead of 8 bits, which would result in 37% equivalent reduction in the display interface bandwidth and processing requirements. The limit would be the case of full white (or black) frame, or a sub-region of the frame, in which case all of the pixel values of that frame, or sub-region of the frame, would be reduced to 1-bit, thus realizing more than 87% equivalent reduction in the display interface bandwidth and processing requirements. Since the dynamic gamut display system of this invention would still need to be built to be able to handle the maximum pixels' value word-length, such a realized reduction in the display interface and processing requirements can be traded for a commensurate reduction in power consumption by gating the processing clock of the display processing subsystem to an equivalently lower clock rate. Thus in this embodiment of the dynamic gamut display system of this invention, the typically smaller adapted gamut 120 would allow a reduced interface and processing bandwidth requirements for the display while also reducing the display power consumption even further.

Figure 5:
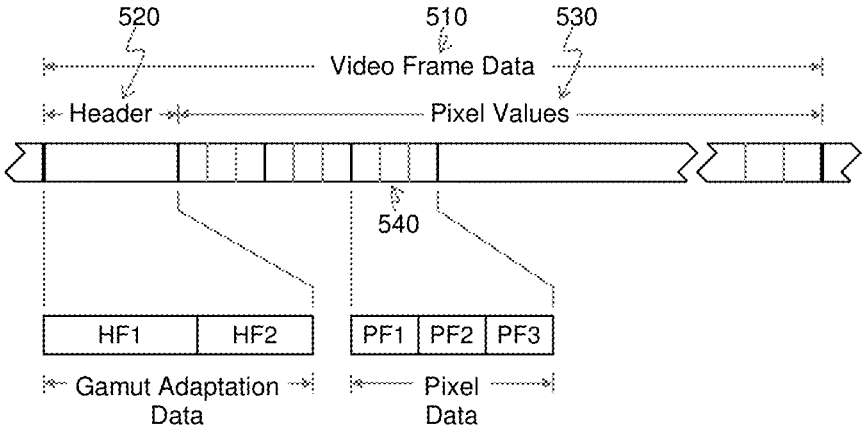
FIG. 5 illustrates the frame data interface format between the dynamic gamut processing blocks of this invention, illustrated in FIG. 2, and the display.

FIG. 5 illustrates the format of the frame data interface between the dynamic gamut processing blocks 200 illustrated in FIG. 2 and the display. As shown in FIG. 2, two types of data would be transferred from the dynamic gamut processing blocks 200 to the display; namely, the gamut adaptation data 208 and the pixel modulation data 210. As illustrated in FIG. 5, these two types of data are multiplexed into a video data frame 510 that is comprised of two corresponding segments; namely, the header 520 and the pixel data sub-frame 530; respectively. As illustrated in the expanded view of FIG. 5, the header segment 520 is further partitioned into two data fields each containing the values of the scale factors listed in Table 2. The first data field HF1 of the frame data header segment 520 would contain the data needed to synthesize the video reference gamut 110 from the display native gamut 105 and a set the display operational parameters such as the white point chromaticity and brightness. Accordingly, data field HF1 of the frame data header segment 520 would contain the Color and the Gain scale factors listed in Table 2; namely, ($R_{R''}$, $R_{G''}$, $R_{B''}$), ($G_{R''}$, $G_{G''}$, $G_{B''}$), ($B_{R''}$, $B_{G''}$, $B_{B''}$) and $S_{gain}$; respectively. As explained earlier, these sets of scale factors are used to specify how the video frame reference gamut 110 and desired white point 115 and brightness are to be synthesized using the native gamut 105 color primaries (R",G",B") of the SSL-based display. It should be noted that although the frame data header segment 520 changes each time the gamut is adapted (either for each frame of a sub-region of a frame), the data field HF1 would be changed only when the video reference gamut 110, the display white point 115 chromaticity or brightness are changed, which would typically occur infrequently only when the operational requirements of the display system are changed or to compensate for possible drift in the native gamut 105 color primaries (R",G",B") chromaticity or associated luminance. In order to save the data interface bandwidth, it is possible to incorporate a change flag word that can be used to indicate if the HF1 field values are to be changed with the data added into the HF1 field after the flag word.

The second data field HF2 of the frame data header segment 520 would contain gamut adaptation data that changes each time the gamut is adapted, either each frame or sub-region of the frame, as the case may be, and inserted within the pixels' data sub-frame to convey video frame sub-region gamut adaptation. In one embodiment, when the dynamic gamut gain is realized as a brightness increase, the data field HF2 of the frame data header segment 520 would contain the Gain scale factor $W_{gain}$ and the Gamut scale factors ($F_R$, $F_G$, $F_B$) listed in Table 2. It should be noted that in terms of bit precision, the Gamut scale factors ($F_R$, $F_G$, $F_B$) could be expressed in multiple number of bits, for example 8 bits, to set the desired level of precision in adapting the display gamut. Alternatively, when the gamut adaptation is restricted to a discrete set of values, as illustrated in FIG. 4*b*, then the Gamut scale factors ($F_R$, $F_G$, $F_B$) would be expressed in a number of bits that is commensurate with the number of discrete values the gamut primaries can be adapted to (see FIG. 4*b*). For example, only 4 bits would be sufficient to express the Gamut scale factors ($F_R$, $F_G$, $F_B$) when the gamut primaries can be adapted into only 16 discrete values. The Gain scale factor $W_{gain}$ would need to be expressed in the number bits sufficient to maintain a precise control of the white point brightness as the gamut is adapted, and typically 8 bits are sufficient to express that scale factor. It should be noted that in the embodiment mentioned earlier when the dynamic gamut brightness gain is preferably traded for a reduced power consumption, the value of the brightness scale factor $S_{gain}$ would be changed each time the gamut is adapted in order to proportionally change the display SSL sources turn-on times (see Eq. 9) and correspondingly convert the brightness gain into a power consumption reduction. In this embodiment, the adapted value of the scale factor $S_{gain}$ would be contained in the data field HF2 instead of the data field HF1, since it would be changed each time the gamut is adapted. In this case, the adapted Gain scale factor $S_{gain}$ would need to be expressed in the number bits sufficient to maintain a precise control of the display brightness as the gamut is adapted, and typically 8 bits are sufficient to express that scale factor.

The major portion of the frame data 510 would be data sub-frame 540 containing the R'G'B' pixel values 210 generated by the gamut conversion block 209, which reference the pixels' values to the adapted gamut 120 conveyed in the data field HF2 of the frame header 520. In one embodiment, each pixel value would have three data fields PF1, PF2 and PF3 representing the R'G'B' pixels' values; respectively, in reference to the adapted gamut 120, where each pixel value data field is comprised of the same number of bits (word length) as the original pixel values input 201 to the dynamic gamut display system, for example, 8-bit word in each of the three data fields PF1, PF2 and PF3 representing the R'G'B' pixel values. In this case, as explained earlier, the display dynamic range (or color representation precession) will increase beyond that set forth by the original pixel values input 201, since the same number of bits are used to express the pixel values relative to the smaller size adapted gamut 120. Alternatively, as explained earlier, the display color representation precession (or dynamic range) can be kept at the level set forth by the original pixel values input 201, then fewer bits can be used in the three data fields PF1, PF2 and PF3 to represent the R'G'B' pixel values. In this case, the number of bits used in three data fields PF1, PF2 and PF3 would be determined from the Gamut scale factors ($F_R$, $F_G$, $F_B$) contained in the header data filed HF2. For example, when an 8-bit word was used to express the original pixel values input 201 and the Gamut scale factor value $0.5<F_R<1$, then 8 bits are used in the pixel value data field PHF1, and when $0.25<F_R<0.5$, then 7 bits are used in the pixel value data field PHF1 and so on, until when $F_R=0$ in which case the pixel value would be expressed using 1-bit PHF1 data field to express either full white or black pixel. Similarly for Green and Blue the values scale factors $F_G$ and $F_B$ are used to determine the pixel values PF2 and PF3 word length (or size in bits). When this source encoding approach is used, the word length expressing the three data fields PF1, PF2 and PF3 representing the R'G'B' pixels' values 210 will adapt with the adaptation of the gamut color primaries, thus leading to an overall smaller size (in bits) of the pixel values 540 portion of the frame data 510. The described method for source encoding the R'G'B' pixels' values 210 output of the dynamic gamut video frame based on the values of the R'G'B'gamut scale factor ($F_R$, $F_G$, $F_B$) conveyed the data frame header HF2 would result in a data reduction (or compression) that is commensurate with the reduction in the display operational gamut resulting from the gamut adaptation. For example, if in the average the gamut adaptation results in a 35% reduction in the display operational gamut relative to the video reference gamut 110, then it would be expected that the described dynamic gamut video frame source encoding method would result in a comparable 35% reduction in the size of the display operational video frame data size. This reduction in the size of the display operational video frame data would result in a commensurate reduction in the computational throughput and memory requirements at the display side, which would in turn result in a proportional reduction in the display system power consumption when the display processor speed is gated proportionally as mentioned earlier.

Figure 6A:
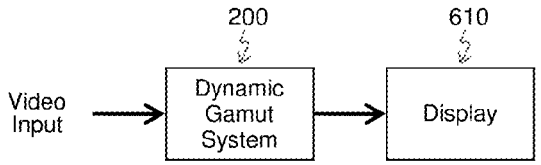
FIG. 6*a* illustrates one application of the dynamic gamut display system of this invention with a collocated display.

FIG. 6*a* illustrates one application of the dynamic gamut display system of this invention that realizes its described benefits. Referring to FIG. 6*a*, the dynamic gamut display system of this invention is realized by incorporating, co-locating or integrating the dynamic gamut processing elements 200 with the display 610. It should be noted, however, that the display 610 would have to be capable of accepting the R'G'B' pixels' values 210 and the gamut adaptation output 208 of the dynamic gamut processing elements 200 and adapt its native gamut and internal processing of the adapted video frame data in accordance with the described gamut adaptation 212. Ref [2-5] describes examples of SSL-based display systems that can be used to realize the described benefits of dynamic gamut display system of this invention in accordance with the application approach illustrated in FIG. 6*a*.

Figure 6B:
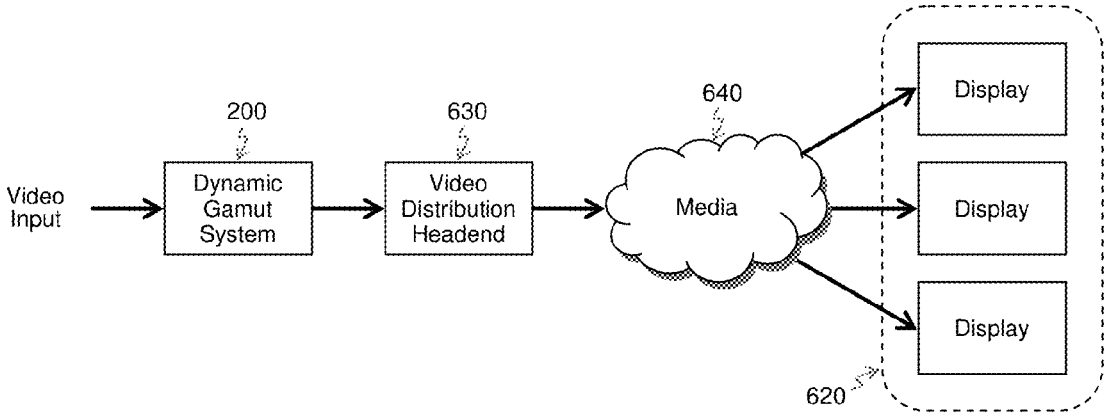
FIG. 6*b* illustrates one application of the dynamic gamut display system of this invention with remote displays.

FIG. 6*b* illustrates another application of the dynamic gamut display system of this invention that realizes its described benefits at the display plus added benefits beyond the display itself. In FIG. 6*b*, the dynamic gamut processing 200 is incorporated, co-located or integrated with the video distribution headend 630. In this embodiment, the dynamic gamut processing 200 is performed at the headend site 630, and its video frame data 210, formatted as described earlier and illustrated in FIG. 5, is transmitted (or distributed) to multiple displays 620 across a transmission media 640 such the internet, a mobile wireless network, or a local area network or using a batch media such as a CD or flash memory module. The realized benefits of the dynamic gamut display system of this invention at the display side 620 would still be the same as in the application illustrated in FIG. 6*a*, but with the added benefits that the dynamic gamut processing 200 is done remote to the display, thus making it possible to realize even more power consumption savings plus cost reduction at the displays 620 side. An added benefit of the application illustrate in FIG. 6*b* is that the reduction in video frame data interface bandwidth described earlier would now also be realized as a reduction in the bandwidth required to transmit (distribute) the video across the transmission media. For example, if in the average the gamut adaptation results in a 35% reduction in the adapted video frame data size relative to the original video frame data size, then it would be expected that the described dynamic gamut methods of this invention would result in a comparable 35% reduction in the media bandwidth required to transmit the video data.

It should be noted that in the application of the dynamic gamut system of this invention, illustrated in FIG. 6*b*, the frame gamut adaptation would be conveyed only relative to the reference gamut 110, since the remote displays 620 could each have a different native gamut 105. That is to say, the frame data header 520 need only incorporate the HF2 part of the frame header. Thus in this embodiment, the displays 620 would each on its own synthesize the video reference gamut 110 color primaries (R,G,B) using their native gamut 105 color primaries (R",G",B"), then use the scale factors ($F_R$, $F_G$, $F_B$) and $W_{gain}$ conveyed in the HF2 data field of the frame header 720 in order to synthesize the adapted gamut 120 color primaries (R',G',B'), then directly modulate the source encoded R'G'B' pixels' data fields PF1, PF2 and PF3 as conveyed compressed in the sub-frame 530 as explained earlier. In the case of the described application of the dynamic gamut display system of this invention in accordance with FIG. 6*b*, the described benefits of the dynamic gamut system of this invention are realized at the video transmission (distribution) headend 630, the video distribution media 640 and at the displays 620. It should be mentioned that the application of the dynamic gamut system of this invention in accordance with FIG. 6*b* does not preclude displays 620 that are not capable of adapting their gamut, as in such cases a processing function (or decoder) added to supplement such displays would process the frame header field HF2 data to decode pixel data fields PF1, PF2 and PF3 and convert these pixels' data fields to the reference gamut 110 RGB pixel data.

Results—

Figure 7A:
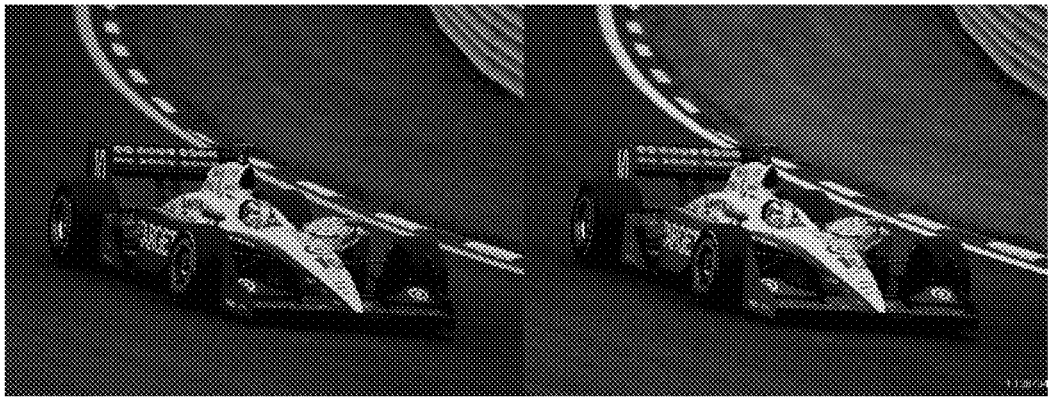
FIG. 7*a* illustrates an example of applying the methods of this invention.
Figure 7B:
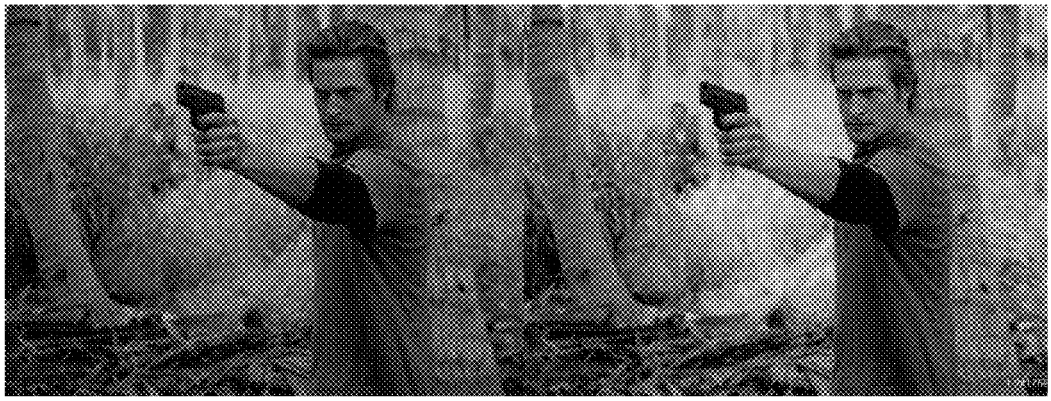
FIG. 7*b* illustrates another example of applying the methods of this invention.
Figure 7C:
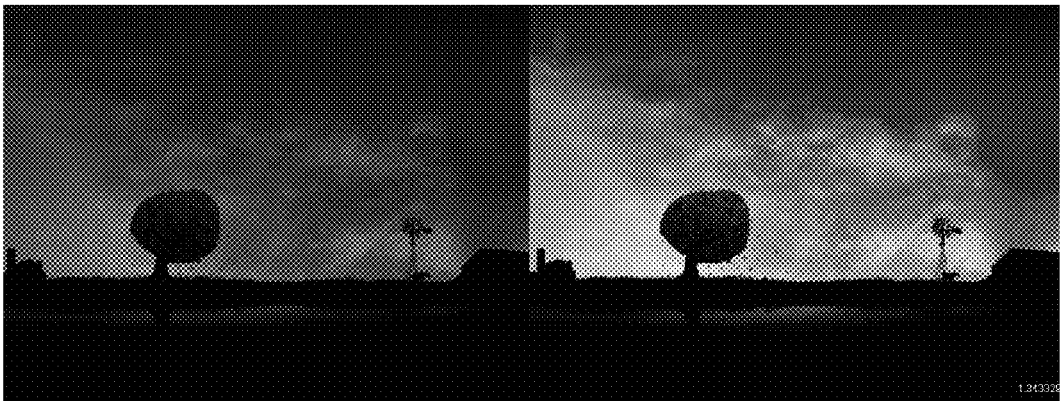
FIG. 7*c* illustrates another example of applying the methods of this invention.
Figure 7D:
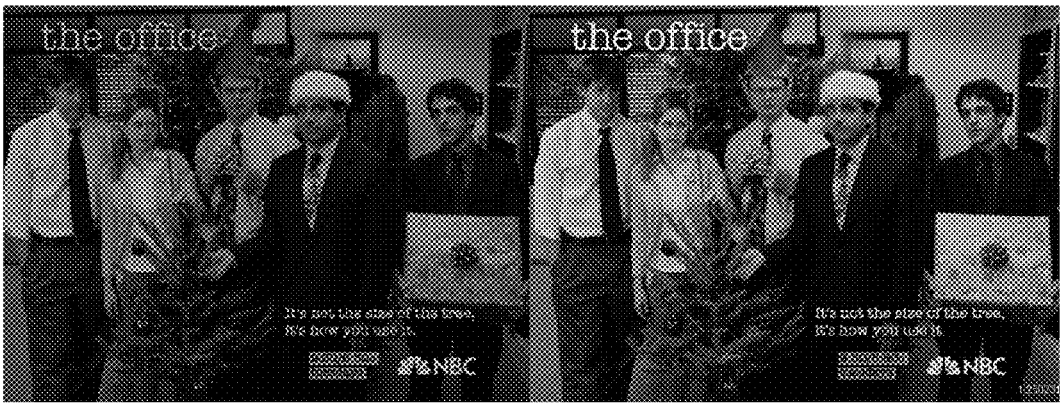
FIG. 7*d* illustrates another example of applying the methods of this invention.

The described methods of the dynamic gamut display system of this invention were tested on multiple video frame examples, and the results are shown in FIG. 7*a* through FIG. 7*d*. The tested video frames were deliberately chosen to have varying degrees of color correlation in order to test and illustrate the performance of the dynamic gamut system of this invention. The SSL-based display used incorporated the capabilities described in Ref [1-5] that allows the display system to accept the described adapted video frame inputs 208 and 210. The performance metric (or figure of merit) used to evaluate the performance of the dynamic gamut display system of this invention was the increased brightness. In the presented results, all the frame pixels were processed, and one adapted gamut was generated for the entire frame. As can be seen for the test results of FIG. 7*a* through FIG. 7*d*, the adapted frame gamut of these examples resulted in increased brightness in the range from 13% to 35%, depending on the frame color content. The tested video frames included multiple isolated sub-regions of a dominant color that are highly saturated; namely, that of FIG. 7*a* showed the least brightness increase of 13% due to the adapted gamut being not much smaller than the reference gamut. On the other hand, the tested video frame included high level of color correlation across fewer sub-regions; namely, that of FIG. 7*c* showed the highest brightness increase of 34% due to the adapted gamut being much smaller than the reference gamut. As expected, the tested video frame included less color correlation within the sub-regions of the frame but narrower color distribution across the entire frame; namely, that of FIG. 7*b* and FIG. 7*d* showed the medium value of brightness increase of about 24% to 25% due to adapted the gamut being smaller than the reference gamut but including a more spread color primaries distribution. Because the tested video examples did not include the extreme cases of large sub-regions f white, black or less saturated colors (such as blue sky, for example), our test results are somewhat conservative examples of the performance gains of the dynamic gamut display system of this invention. Thus, in the average with a typical video frame sequence, the described dynamic gamut methods of this invention are expected to provide a higher performance gain than the average brightness gain of 24% illustrated by the test examples shown in FIG. 7.

Those skilled in the art will readily appreciate that various modifications and changes can be applied to the embodiments of the invention without departing from its scope defined in and by the appended claims. It should be appreciated that the foregoing examples of the invention are illustrative only, and that the invention can be embodied in other specific forms without departing from the spirit or essential characteristics thereof. The disclosed embodiments, therefore, should not be considered to be restrictive in any sense. The scope of the invention is indicated by the appended claims, rather than the preceding description, and all variations which fall within the meaning and range of equivalents thereof are intended to be embraced therein.

What is claimed is:

1. A dynamic gamut display system method for solid state light based displays using emissive micro-pixel array devices wherein each color of each pixel is independently controllable without a backlight, each solid state light based display having a display native gamut, comprising:

buffering in a buffer, an input video frame pixel data expressed relative to a defined three primary reference color gamut having a defined reference white point;

processing the input video frame pixel data as the input video frame pixel data is entered into the buffer to calculate a set of gamut metrics for the respective video frame representing, for each primary reference color in the input video frame pixel data, a respective mean and spread from the mean in the input video frame pixel data around the white point of the reference color gamut;

calculating a set of gamut scale factors that represent the distribution of each primary reference color in the input video frame pixel data around the white point of the reference color gamut;

using the gamut scale factors, determining an adapted color gamut around the white point of the reference color gamut;

using a matrix for converting pixel color values from the reference gamut to the adapted color gamut and the gamut scale factors, converting the buffered input video frame pixels data from the reference color gamut to the adapted color gamut; and outputting the adapted gamut, and outputting the buffered input video frame pixel data as converted from the reference color gamut to the adapted color gamut, to a display of the dynamic gamut display system, both outputs being expressed in the display native gamut.

2. The method of claim 1 wherein the set of gamut metrics are a set of respective minimum distances from a frame's pixels' chromaticity position to lines extending from the defined reference white point to three color primaries of the defined three primary reference color gamut.

3. The method of claim 2 wherein the set of gamut metrics are converted to normalized gamut metrics values ranging from 0 to 1, with a gamut metric having a value close to 0 being close to the defined reference white point and a gamut metric having a value close to 1 being closer to a respective one of the three primaries of the defined three primary reference color gamut.

4. The method of claim 3 wherein the respective normalized gamut metrics values or the respective minimum distances are assigned a value 0.0 if a line representing the respective minimum distance intersects the respective line extending from the defined reference white point to the respective one of the three color primaries of the defined three primary reference color gamut.

5. The method of claim 3 wherein the normalized gamut metrics values are integrated in a pair of running accumulators for each of three color primaries of the defined three primary reference color gamut, the running accumulators incorporating a pixel counter, an output of a first of each pair of running accumulators representing a mean of the normalized gamut metrics values of the respective one of the three primaries of the defined three primary reference color gamut and an output of a second of each pair of running accumulators representing a spread of the normalized gamut metrics values of the respective one of the three primaries of the defined three primary reference color gamut.

6. The method of claim 5 wherein the set of gamut scale factors are calculated as a minimum of either a value 1 or a sum of the outputs of the two running accumulators to represent a spread of the frame's pixels' chromaticity around the defined reference white point.

7. The method of claim 6 wherein the set of gamut scale factors are used to represent the adapted color gamut that substantially includes the frame's pixels' chromaticity.

8. The method of claim 7 further comprising calculating a 3×3 matrix using the set of gamut scale factors to convert the buffered input video frame pixel data to adapted frame pixel data in the adapted color gamut and converting the buffered input video frame pixel data to adapted frame pixel data in the adapted color gamut.

9. The method of claim 7 wherein a display native gamut of the display element is not identical to the defined three primary reference color gamut, and further comprising synthesizing the color primaries of the adapted color gamut using the set of gamut scale factors and color primaries of the display native gamut.

10. The method of claim 9 further comprising synthesizing the color primaries of the adapted color gamut using the set of gamut scale factors and the defined three primary reference color gamut, and additional scale factors representing values of a desired display brightness, white point chromaticity and brightness.

11. The method of clam 10 wherein the display element synthesizes the color primaries of the adapted color gamut and modulates the adapted frame pixel data using the synthesized color primaries of the adapted color gamut.

12. The method of claim 5 wherein each pair of running accumulators provide their outputs when their pixel counters reach a respective preset maximum value that is either a full pixel count within the buffered input video frame or a pixel count within a sub-region of the buffered input video frame, thus allowing adaptation of the adapted color gamut once per buffered input video frame or multiple times per buffered input video frame.

13. The method of claim 12 wherein the respective preset maximum value of each pair of running accumulators is selected to enable adaptation of a display native gamut multiple times per input video frame to enable the adapted display native gamut to match a gamut of multiple equal or non-equal size sub-regions of the input video frame.

14. The method of claim 5 wherein the running accumulators are configured to provide running accumulator outputs after their pixel counter reaches a preset minimum pixel count value and their accumulated normalized gamut metrics values fall between a predefined set of thresholds that partition a full range of the accumulated normalized gamut metric values into a discrete set of segments to enable the adapted color gamut to match the gamut of multiple non-equal size sub-regions of the input video frame data having different levels of color correlation.

15. The method of claim 10 wherein the color primaries of the adapted color gamut are synthesized by adjusting the turn-on times of the color primaries of the display native gamut by two components, a first component being the values of the color primaries of the display native gamut needed to synthesize the reference color gamut weighted by the additional scale factors, and a second component being values of the display element white point, chromaticity and brightness complementarily weighted by the additional scale factors.

16. The method of claim 1 wherein an interface apparatus for practicing the method is collocated with the solid state light based display.

17. The method of claim 1 wherein an interface apparatus for practicing the method is remotely located from the solid state light based display, and is either embedded within or supplementary to the solid state light based display, whereby the adapted color gamut and the adapted frame pixel data are coupled to the interface apparatus embedded within or supplementary to the solid state light based display via a cable network, a local area network, a mobile wireless network, the Internet, or a batch media.

18. The method of claim 17, wherein the apparatus for practicing the method is either incorporated, co-located or accumulated with a video distribution headend that couples the adapted color gamut and the adapted frame pixel data through an interface to a multiplicity of display elements via the Internet, the mobile wireless network, the local area network or a batch media, the multiplicity of display elements including but not limited to the solid state light based display.

19. The method of claim 18, as applied to reduce a bandwidth of the interface.

20. The method of claim 19 wherein the multiplicity of display elements include a display element not capable of adapting its gamut, and wherein a processing function is added to process data frames to decode the respective adapted frame pixel data to convert the adapted frame pixel data to pixels' data relative to the gamut of the respective display element.

21. The method of claim 1 wherein the adapted color gamut and the adapted frame pixel data are outputted to the solid state light based display in a data stream comprising data frames that convey video frame synchronization data plus a header data sub-frame followed by respective adapted frame pixel data, and wherein:

the header data sub-frame is comprised of two data fields, wherein:

the first data field of the header data sub-frame conveys data needed to synthesize the defined reference color gamut from the display native gamut and set the display operational white point chromaticity and brightness, and the second data field of the header data sub-frame conveys a set of gamut scale factors, and a pixels' data sub-frame conveys the respective adapted frame pixel data.

22. The method of claim 21 wherein the first data field of the header data sub-frame is changed only when the defined three primary reference color gamut or brightness or white point chromaticity of the solid state light based display is changed.

23. The method of clam 22 wherein a change in the first data field of the header data sub-frame is indicated by a change flag incorporated in the first data field of the header data sub-frame.

24. The method of claim 21 wherein the second data field of the header data sub-frame is changed each time the defined three primary reference gamut is converted to the adapted color gamut, either each frame or sub-region of each frame and inserted within the pixels' data sub-frame to convey the video frame or video frame sub-region adapted color gamut.

25. The method of claim 21 wherein the adapted frame pixel data as conveyed by the pixels' data sub-frame is represented by either the same number of bits as the input video frame pixel data, or a fewer number of bits than the input video frame pixel data as determined by the set of gamut scale factors and conveyed by the second data field of the header data sub-frame.

26. The method of claim 25, used to provide a reduction in a number of bits of the pixels' data sub-frame that is responsive a reduction in a number of bits representing the adapted color gamut relative to a number of bits of the defined three primary reference color gamut.

27. The method of claim 1, as applied to either increase brightness or reduce a power consumption of the display element.

28. The method of claim 1, as applied to increase a color representation precision of the display element.

29. The method of claim 1, as applied to reduce interface and processing bandwidth of the display element.

30. A dynamic gamut display system method for solid state light based displays using emissive micro-pixel array devices wherein each color of each pixel is independently controllable without a backlight, each solid state light based display having a display native gamut, comprising;

buffering in a buffer, an input video frame pixel data expressed relative to a defined three primary reference color gamut having a defined reference white point;

processing the input video frame pixel data as the input video frame pixel data is entered into the buffer to calculate a set of gamut metrics for the respective input video frame pixel data or each sub-region of the respective input video frame pixel data representing, for each primary reference color in the input video frame pixel data or a sub-region pixel data, a respective mean and spread from the mean in the respective input video frame pixel data or sub-region pixel data around the reference white point of the three primary reference color gamut;

calculating a set of gamut scale factors that represent distribution of each primary reference color in the input video frame pixel data or sub-region pixel data around the reference white point of the three primary reference color gamut;

using the gamut scale factors, determining an adapted color gamut around the reference white point of the three primary reference color gamut for the respective input video frame pixel data or sub-region pixel data;

using a matrix for converting pixel color values from the three primary reference color gamut to the adapted color gamut and the gamut scale factors, converting the buffered input video frame pixel data or sub-region pixel data from the three primary reference color gamut to the adapted color gamut; and outputting the adapted color gamut, and outputting the buffered input video frame pixel data or sub-region pixel data as converted from the three primary reference color gamut to the adapted color gamut, to a display of the dynamic gamut display system, both outputs being expressed in the display native gamut.

31. A dynamic gamut display system method for solid state light based displays using emissive micro-pixel array devices wherein each color of each pixel is independently controllable without a backlight, each solid state light based display having a display native gamut, comprising:

buffering in a buffer, an input video frame pixel data expressed relative to a defined three primary reference color gamut having a defined reference white point;

processing the input video frame pixel data as the input video frame pixel data is entered into the buffer to calculate a set of gamut metrics for each respective input video frame sub-region pixel data of the respective input video frame pixel data representing, for each primary reference color in the input video frame sub-region pixel data, a respective mean and spread from the mean in the input video frame sub-region pixel data around the reference white point of the three primary reference color gamut;

calculating a set of gamut scale factors that represent distribution of each primary reference color in the input video frame sub-region pixel data around the reference white point of the three primary reference color gamut;

using the gamut scale factors for each input video frame sub-region pixel data, determining an adapted color gamut around the reference white point of the three primary reference color gamut;

using a matrix for converting pixel color values from the three primary reference color gamut to the adapted color gamut and the gamut scale factors, converting the buffered input video frame pixel data or input video frame sub-region pixel data from the three primary reference color gamut to the adapted color gamut; and outputting the adapted color gamut, and outputting the buffered input video frame sub-region pixel data as converted from the three primary reference color gamut to the adapted color gamut, to a display of the dynamic gamut display system, both outputs being expressed in the display native gamut.

* * * * *